US007778569B2

(12) United States Patent
Igarashi

(10) Patent No.: US 7,778,569 B2
(45) Date of Patent: Aug. 17, 2010

(54) IMAGE FORMING APPARATUS

(75) Inventor: Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 550 days.

(21) Appl. No.: 11/828,647

(22) Filed: Jul. 26, 2007

(65) Prior Publication Data

US 2008/0025749 A1 Jan. 31, 2008

(30) Foreign Application Priority Data

Jul. 27, 2006 (JP) ..... 2006-204883

(51) Int. Cl.
*G03G 15/00* (2006.01)

(52) U.S. Cl. ..... 399/110

(58) Field of Classification Search ..... 399/92, 399/107, 110, 124, 125, 130; 347/152
See application file for complete search history.

(56) References Cited

U.S. PATENT DOCUMENTS

| | | | | |
|---|---|---|---|---|
| 5,581,342 | A * | 12/1996 | Yamauchi | 399/123 |
| 5,933,697 | A | 8/1999 | Onodera et al. | |
| 7,147,218 | B2 * | 12/2006 | Izumi et al. | 271/145 |
| 7,529,500 | B2 * | 5/2009 | Eguchi | 399/107 |
| 2005/0214028 | A1 * | 9/2005 | Yasumoto | 399/124 |
| 2006/0051125 | A1 * | 3/2006 | Nakayama | 399/110 |

FOREIGN PATENT DOCUMENTS

| | | |
|---|---|---|
| JP | 51-031592 | 3/1975 |
| JP | 63-002971 | 1/1988 |
| JP | 03-064754 | 3/1991 |
| JP | 4-156560 | 5/1992 |
| JP | 7-140857 | 6/1995 |
| JP | 7-271123 | 10/1995 |
| JP | 8-290631 | 11/1996 |
| JP | 10-148987 | 6/1998 |
| JP | 11-129576 | 5/1999 |
| JP | 2001-281771 | 10/2001 |
| JP | 2002-067437 | 3/2002 |
| JP | 2004-258149 | 9/2004 |
| JP | 2005-041629 | 2/2005 |
| JP | 2005-091482 | 4/2005 |
| JP | 2005-141020 | 6/2005 |

* cited by examiner

*Primary Examiner*—David P Porta
*Assistant Examiner*—Kiho Kim
(74) *Attorney, Agent, or Firm*—Banner & Witcoff, Ltd.

(57) ABSTRACT

An image forming apparatus includes a main body casing, a device that is positioned within a main body casing and having a function, a displacement member positioned in a main body casing and capable of displacement between an initial position and a stop position which causes the device to perform an action, a string-like connection that is connected between the displacement member and a cover member and that displaces the displacement member from the initial position to the stop position in synchronization with the opening operation of the cover member. The string-like connection, and the displacement member in the stop position, constitute an opening restricting device capable of restricting the opening angle of a cover member to a prescribed angle.

18 Claims, 33 Drawing Sheets

IMAGE FORMING APPARATUS

CROSS REFERENCE TO RELATED APPLICATION

This application claims priority from Japanese Patent Application No. 2006-204883 filed Jul. 27, 2006. The entire content of this priority application is incorporated herein by reference.

TECHNICAL FIELD

The present invention relates to an image forming apparatus.

BACKGROUND

In an image forming apparatus described in Japanese Patent Laid-Open No. 2005-91482, for example, devices on the side of the main body casing are activated in synchronization with the opening and closing of a cover member that opens and closes the main body casing. In this image forming apparatus, a protective mechanism that protects a photosensitive body is provided within a housing (corresponding to the above-described main body casing) and a strap for synchronization is provided between an opening and closing member (corresponding to the above-described cover member) and the housing.

As a result of this, when the opening and closing member is opened or closed, the strap rotates a shaft member provided within the housing and this rotation of the shaft member actuates the protective mechanism that protects a photosensitive body. As described above, the image forming apparatus of Patent Document 1 actuates one device (the protective mechanism of a photosensitive body) in synchronization with the opening and closing of the opening and closing member provided within the housing.

In the image forming apparatus, the opening and closing of the above-described cover member is performed, for example, when built-in parts are replaced. In this case, the replacement work of parts cannot be often performed only by opening the cover member for access, and in order to perform replacement work, it is necessary to disengage built-in parts from each other or to cause a part that is an obstruction to retract. However, it is troublesome that each time the replacement of parts is performed, the worker is forced to perform the operation for disengagement of the connecting parts or the operation for causing a part that is an obstruction to retract, and the maintainability is poor. Also from this viewpoint, if it is possible to actuate a plurality of devices in synchronization with the opening and closing of the cover member, operability is improved and marketability is raised.

Thus, there is a need in the art for an image forming apparatus capable of activating a plurality of mechanisms on the main body side of the apparatus in synchronization with the opening and closing of the cover that has increased usability and marketability beyond the devices discussed above.

SUMMARY

One embodiment according to the present invention may include an image forming apparatus having a main body casing, a cover member that is connected to an opening provided in the main body casing via a hinge shaft and closes or opens the opening, a first device that is positioned within the main body casing and has a first function, a first displacement member positioned in the main body casing and is capable of displacement between an initial position and a stop position which causes the first device to perform a first action, a first string-like connection that is connected between the first displacement member and the cover member and that displaces the first displacement member from the initial position to the stop position in synchronization with the opening operation of the cover member, a second device that is positioned within the main body casing and having a second function different from the first function of the first device, a second displacement member that is positioned in the main body casing and is capable of displacement between an initial position and a stop position which causes the second device to perform a second action, and a second string-like connection that is connected between the second displacement member and the cover member and that displaces the second displacement member from the initial position to the stop position in synchronization with the opening operation of the cover member. Wherein, the first and second string-like connections, and the first and second displacement members in the stop position, constitute an opening restricting device and restrict the opening angle of the cover member to a prescribed angle.

According to the present invention, the first displacement member and cover member provided in the main body casing are connected by the first string-like connection. Also, the second displacement member and cover member provided in the main body casing are connected by the second string-like connection. Therefore, when the opening operation of the cover member is performed, the first and second displacement members are drawn in via each of the string-like connections and are each displaced from the initial position to the stop position respectively.

Because of this, the first device is actuated by the displacement operation of the first displacement member, and the second device is actuated by the displacement operation of the second displacement member. In this way, according to the one embodiment of the present invention, it is possible to actuate a plurality of devices (the first device and the second device) on the side of the main body casing by the opening operation of the cover member. Therefore, at least for the plurality of devices that have been actuated, it is unnecessary to perform again a dedicated operation for the actuation of the devices after the opening operation of the cover member, and hence it is possible to save time and labor in operations.

In addition, in the image forming apparatus of the present invention, the first and second string-like connections, along with the first and second displacement members in the stop position, constitute an opening restricting device and restricts the opening angle of the cover member to a prescribed angle. The synchronization mechanism that actuates other devices in synchronization with the opening operation of the cover member also has the function of opening restriction, and thus the mechanism of the apparatus can be made simple.

BRIEF DESCRIPTION OF THE DRAWINGS

Illustrative aspects in accordance with the invention will be described in detail with reference to the following figures wherein.

DETAILED DESCRIPTION OF THE PREFERRED ILLUSTRATIVE ASPECTS

Illustrative aspects in which the image forming apparatus related to the present invention is applied to a laser printer will be described with reference to FIG. 1 to FIG. 33.

1. Construction of Printer

Figure 1:
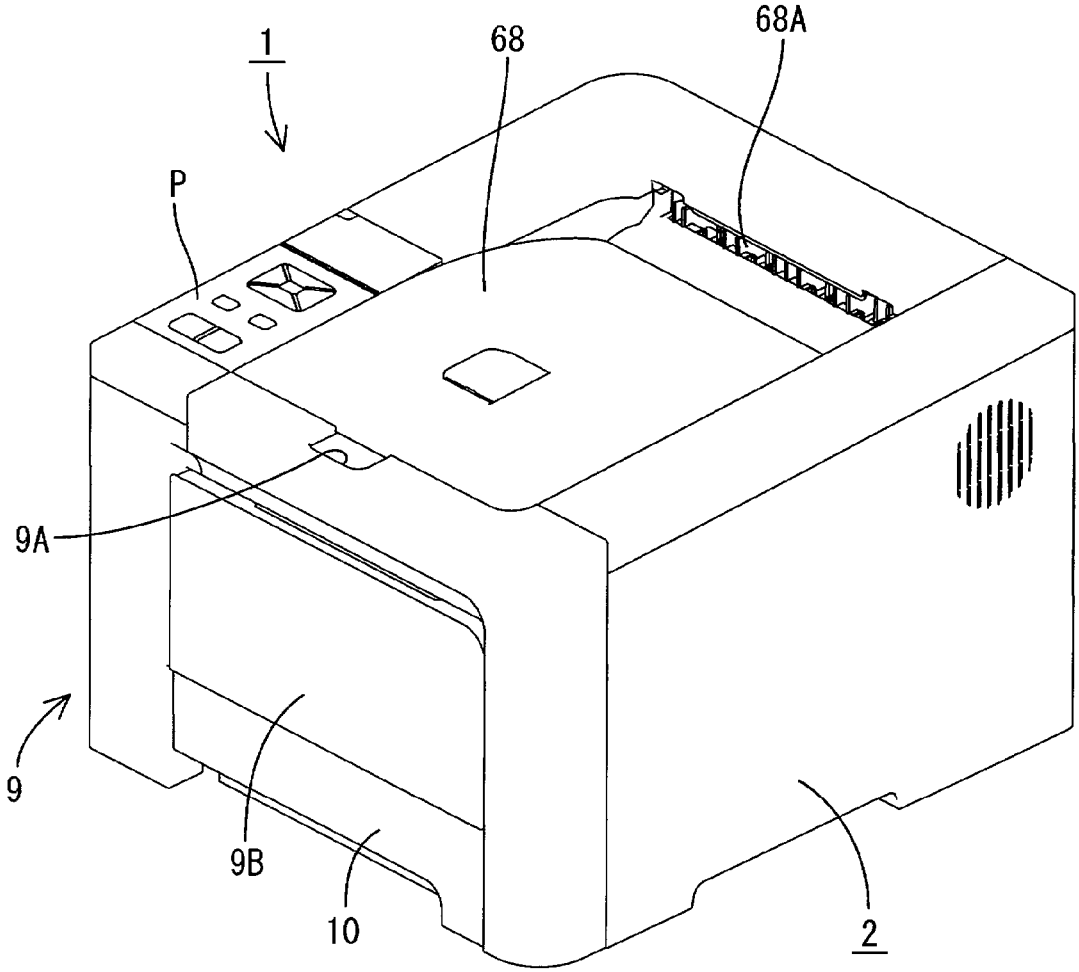
FIG. 1 is a perspective view of a laser printer in one aspect of the invention.

FIG. 1 is a perspective view of a laser printer. A top surface wall of a main body casing 2 is provided in a depressed manner so that the middle portion in the width direction descends a little toward the back side, and this depressed portion serves as a sheet discharge tray 68. A sheet discharge port 68A opens in the portion that constitutes a back wall of the sheet discharge tray 68, and a sheet 3 (after image formation) is discharged through the sheet discharge port 68A from the back side of the apparatus toward the front side. An operation panel P is provided on the top surface wall of the main body casing 2, which is a front leading end portion of the sheet discharge tray 68.

The reference numeral 9 in FIG. 1 denotes a front cover corresponding to a cover member. The front cover 9 is intended for closing the opening (an example of an opening of the present invention) on the front surface of the main body casing 2, and is connected to the main body casing 2 so as to be rotatable around a hinge shaft J (see FIG. 3) as the center. The hinge shaft J is provided in a lower portion of the front surface of the main body casing 2, and a lower portion of the front cover 9 is connected to the hinge shaft J so that the front cover 9 opens upward.

The reference numeral 9B in FIG. 1 denotes a manual feed tray. Although the manual feed tray 9B constitutes part of the front cover 9, the manual feed tray 9B is constituted by a part different from the panel that constitutes the front cover 9. The bottom end portion of the manual feed tray 9B can be rotatably connected to the panel. When the top end of the manual feed tray 9B is manipulated toward the front in FIG. 1, the panel of the front cover 9 rotates so that only the manual feed tray 9B tilts toward the front, with the opening kept closed, thereby causing a manual-feed sheet insertion opening (not shown) to open.

The descriptions that will be given below are based on the assumption that the side on which the front cover 9 is provided (the left front of FIG. 1) is the front side and that the reverse side (the right back side of FIG. 1) is the rear or back side.

Figure 2:
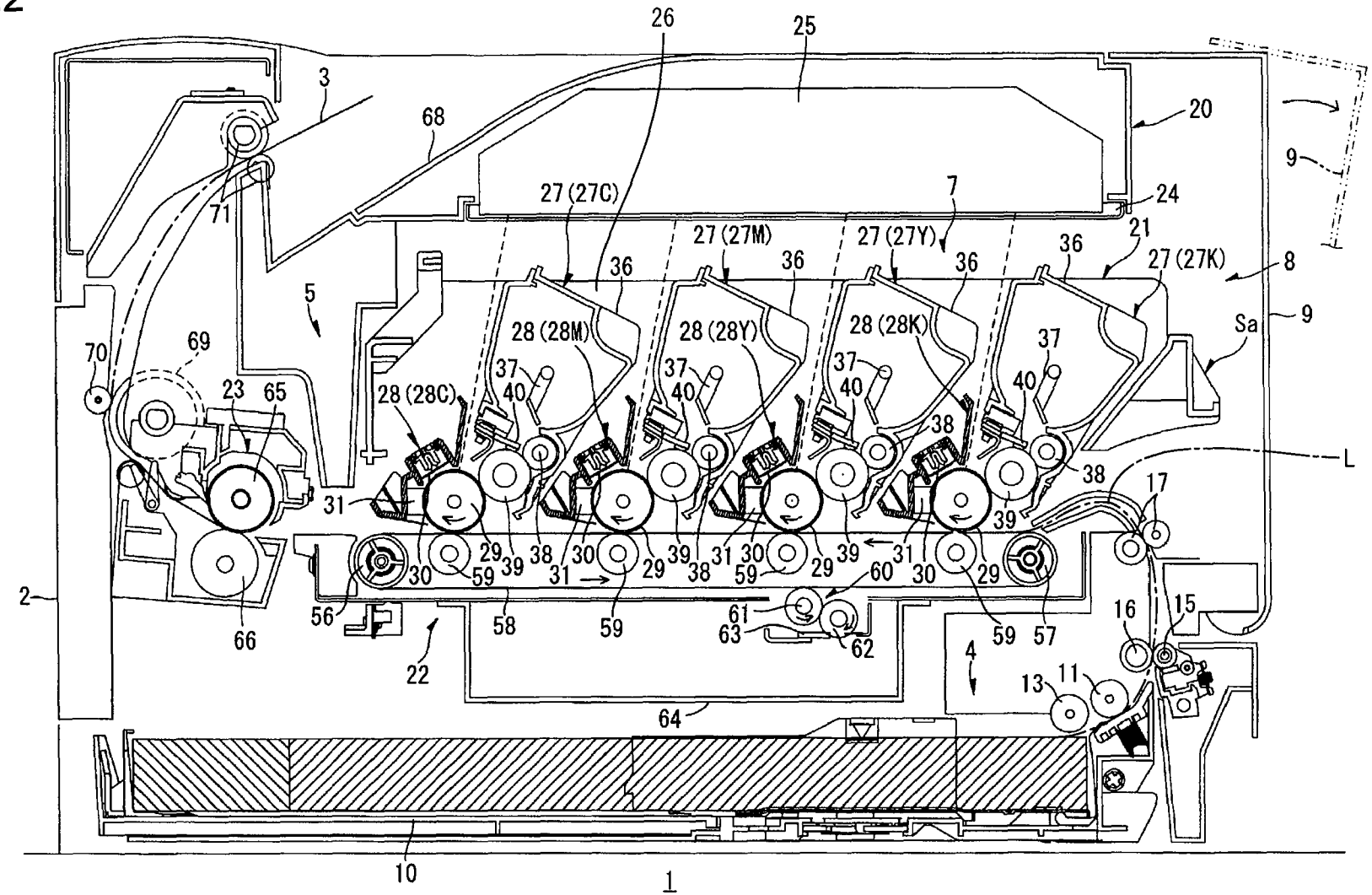
FIG. 2 is a partial side sectional view of a laser printer in one aspect of the invention.

FIG. 2 is a side sectional view of a laser printer. Each of the devices constituting the laser printer will be briefly described below with reference to FIG. 2.

The laser printer 1 is a horizontal-type color laser printer in which, for example, four drum subunits 28K to 28C are arranged side by side in the right and left directions in FIG. 2, and in the main body casing 2 are provided a sheet feeding portion 4 for feeding sheets as a recording medium, an image forming portion 5 for forming an image on a sheet 3 that has been fed, and the like.

The sheet conveyance path L of the laser printer 1, which is as indicated by an alternate long and short dash line in FIG. 2, turns around in an upper portion of the front of a sheet supply portion 4 in the form of the letter U from the front side of the laser printer 1 to the rear side thereof and then heads for the rear of the laser printer 1. And after reaching the rear end side, the sheet transfer path L turns around to the front side in the form of the letter U and follows a course reaching the sheet discharge tray 68 provided on the top surface wall of the main body casing 2.

A toner image is formed on a sheet delivered from the sheet feeding portion 4 during the process of conveyance on the sheet conveyance path L, and the toner image is thermally fixed by a fixing portion 23, whereby a desired color image is formed.

Each of the parts constituting the laser printer will be briefly described below.

(A) Construction of Sheet Feeding Portion

In general, the sheet feeding portion 4 is constituted by a sheet supply cassette 10, a separation roller 11, a sheet feeding roller 13 and the like. The separation roller 11 and the sheet feeding roller 13 are intended for taking out, one by one, sheets stacked on the sheet supply cassette 10. The reference numerals 15, 16 and 17 in FIG. 2 denote, respectively, a powder removing roller, a pinch roller and a resist roller. The powder removing roller 15 is intended for removing the powder on sheets, and the resist roller 17 is intended for correcting the skewing of sheets that have been delivered.

(B) Construction of Image Forming Portion

Generally speaking, the image forming portion 5 is constituted by a scanner portion 20, a process portion 21, a transfer portion 22, a fixing portion 23, and the like.

The scanner portion 20 is arranged on the main body casing 2. This scanner portion 20 is provided with a supporting plate 24 that extends fore-and-aft directions and laterally, and a scanner unit 25 fixed to the top surface of this supporting plate 24. Within the scanner unit 25 are arranged, for example, optical members, such as four laser light sources, a polygon mirror, an fθ lens, a reflecting mirror, and a plane inclination correcting lens. A laser beam based on image data emitted from each of the light sources is deflected by the polygon mirror, passes through the fθ lens and the plane inclination correcting lens, and is reflected by the reflection mirror. After that, the laser beam is applied to the surfaces of photosensitive drums 29 for each color, which will be described later, and an irradiation point on the photosensitive drum 29 is scanned at high speeds by the rotation of the polygon mirror.

The process portion 21 is provided with the four drum subunits 28K to 28C and four development cartridges 27K to 27C, corresponding to colors of black, yellow, magenta, and cyan.

Each of the drum subunits 28K to 28C is constituted by the photosensitive drum 29 as an image carrying member, a charging device 30 (i.e. scorotron type charger), a cleaning brush 31, and the like.

The charging device 30 is arranged opposite to the photosensitive drum 29 in a manner spaced from the photosensitive drum 29 and behind the photosensitive drum 29 on the oblique upper side thereof. The charging device 30 has the function of generating a corona discharge by the application of a high voltage during image formation and causing the surface of the photosensitive drum 29 to be uniformly charged with a positive polarity.

The cleaning brush 31 is arranged so as to be in contact with the photosensitive drum 29 behind the photosensitive drum 29 in a manner opposite to the photosensitive drum 29, and during image formation, a cleaning bias is applied to the cleaning brush 31. This cleaning brush 31 has the function of cleaning the photosensitive drum 29.

In the lower part of a development frame 36 housing a toner, the development cartridges 27K to 27C are provided with a developing roller 39, a supply roller 38 and a layer thickness restricting blade 40. The developing roller 39 and the supply roller 38 are arranged opposite to each other, and have the function of supplying a toner from the supply roller 38 to the developing roller 39 during the passage of the toner between the two, and causing the toner to be frictionally charged with a positive polarity due to the friction caused by the rotation. The layer thickness restricting blade 40 is intended for making the layer thickness of the toner positively charged and uniformly carried on the developing roller 39.

The transfer portion 22 is provided with a driving roller 56, a driven roller 57 and a belt unit in which an sheet conveyance belt 58 is hung across four transfer rollers 59.

The driving roller 56 is such that the surface of cylindrical body made of a metal is coated with a thin rubber material (e.g. an antislip rubber of large friction having a thickness of approximately 0.5 mm), and a driving force is transmitted to the driving roller 56 from a motor (not shown). The driven roller 57 is intended for imparting an appropriate tension to the sheet conveyance belt 58, and is biased by a spring (not shown) in the right-hand direction in FIG. 2.

Each of the transfer rollers 59 is arranged opposite to each of the photosensitive drums 29. For example, the transfer rollers 59 are arranged at equal intervals as with the photosensitive drums 29, with the sheet conveyance belt 58 interposed just under the photosensitive drums 29 that are arranged in the depth direction of the apparatus in an arrayed condition. Each of these transfer rollers 59 is an elastic roller whose metallic roller shaft is coated with an electrically conductive sponge material (for example, the thickness can be approximately 5 mm). A constant-current source (not shown) is connected to the roller shaft of each of the transfer rollers 59, and a transfer bias (voltage of negative polarity) is applied to the roller shaft at a prescribed timing.

The sheet conveyance belt 58 is made of a resin material, such as polycarbonate, and the width of the sheet conveyance belt 58 is not less than the width of a printable maximum sheet size (for example, A4 paper size). And when a driving force is transmitted to the driving roller 56 from a motor (not shown), the driving roller 56 begins to rotate. The sheet conveyance belt 58 is driven in a circulating manner due to the rotation of this driving roller 56 and conveys sheets horizontally from the right-hand side to the left-hand side in FIG. 2.

The reference numeral 60 in FIG. 2 denotes a cleaning portion. The cleaning portion collects the remaining toner adhering to the sheet conveyance belt 58 and cleans the sheet conveyance surface of the sheet conveyance belt 58, the reference numeral 61 denotes a primary cleaning roller, the reference numeral 62 denotes a secondary cleaning roller, the reference numeral 63 denotes a scraping blade, and the reference numeral 64 denotes a toner storing portion.

A brief description will be given here of a series of image forming processing steps by the laser printer 1 constructed as described above. First, the surface of each of the photosensitive drums 29 is positively charged in a uniform manner by the charging device 30 as the surface rotates. After that, when prescribed image data is input from a host device, for example, then control based on the image data is started and a laser beam is applied to each of the photosensitive drums 29 from each of the scanner portions 20. As a result of this, a prescribed electrostatic latent image corresponding to the image data is formed on the surface of each of the photosensitive drums 29, that is, the electric potential drops in the portion irradiated with the laser beam on the surface of the photosensitive drums 29 positively charged in a uniform manner.

Subsequently, the toner carried on the developing roller 39 and positively charged is supplied by the rotation of the developing roller 39 to the electrostatic latent image formed on the surface of each of the photosensitive drums 29. As a result of this, the electrostatic latent image of the photosensitive drums 29 is converted into a visible image and a toner image by reversal development is carried on the surface of the photosensitive drum 29.

In parallel with the processing for forming a toner image described above, the processing for conveying sheets is performed. That is, by the rotation of the sheet feeding roller 13, sheets are delivered one by one from the sheet supply cassette 10 to the sheet conveyance path L. The sheet delivered to the sheet conveyance path L is carried by the pinch roller 16 and the sheet conveyance belt 58 to the transfer position (the point at which each of the photosensitive rollers comes into contact with each of the transfer rollers). Then, during the passing of the sheet through this transfer point, toner images (developer images) of each color carried on the surface of each of the photosensitive drums 29 are transferred in a superimposed manner to the surface of the sheet by a transfer bias applied to each of the transfer rollers 59. In this manner, color toner images (developer images) are formed on the sheet. After that, during the passage through the fixing portion 23 which is described next, the transferred toner images (developer images) are thermally fixed and the sheet is discharged on the sheet discharge tray 68.

The fixing portion 23 is provided on the rear side of the transfer portion 22. The fixing portion 23 is constituted by a heating roller 65 and a pressure roller 66 that is installed opposite to the heating roller 65. The heating roller 65 is provided with a halogen lamp (not shown) for heating and the fixing portion 23 is intended for thermally fixing color toner images (developer images) transferred onto a sheet by each of the transfer rollers 59 while the sheet is passing through the heating roller 65 and the pressure roller 66.

After thermal fixing, the conveyance direction of the sheet 3 is changed to an upward direction at the rear end of the apparatus and the sheet 3 reaches the top surface wall of the main body casing. And the sheet 3 is discharged by a sheet discharge roller 71 onto the sheet discharge tray 68. The reference numerals 69 and 70 denote, respectively, a conveyance roller and a pinch roller.

2. Insertion and Extraction of Drum Unit Sa

Figure 3:
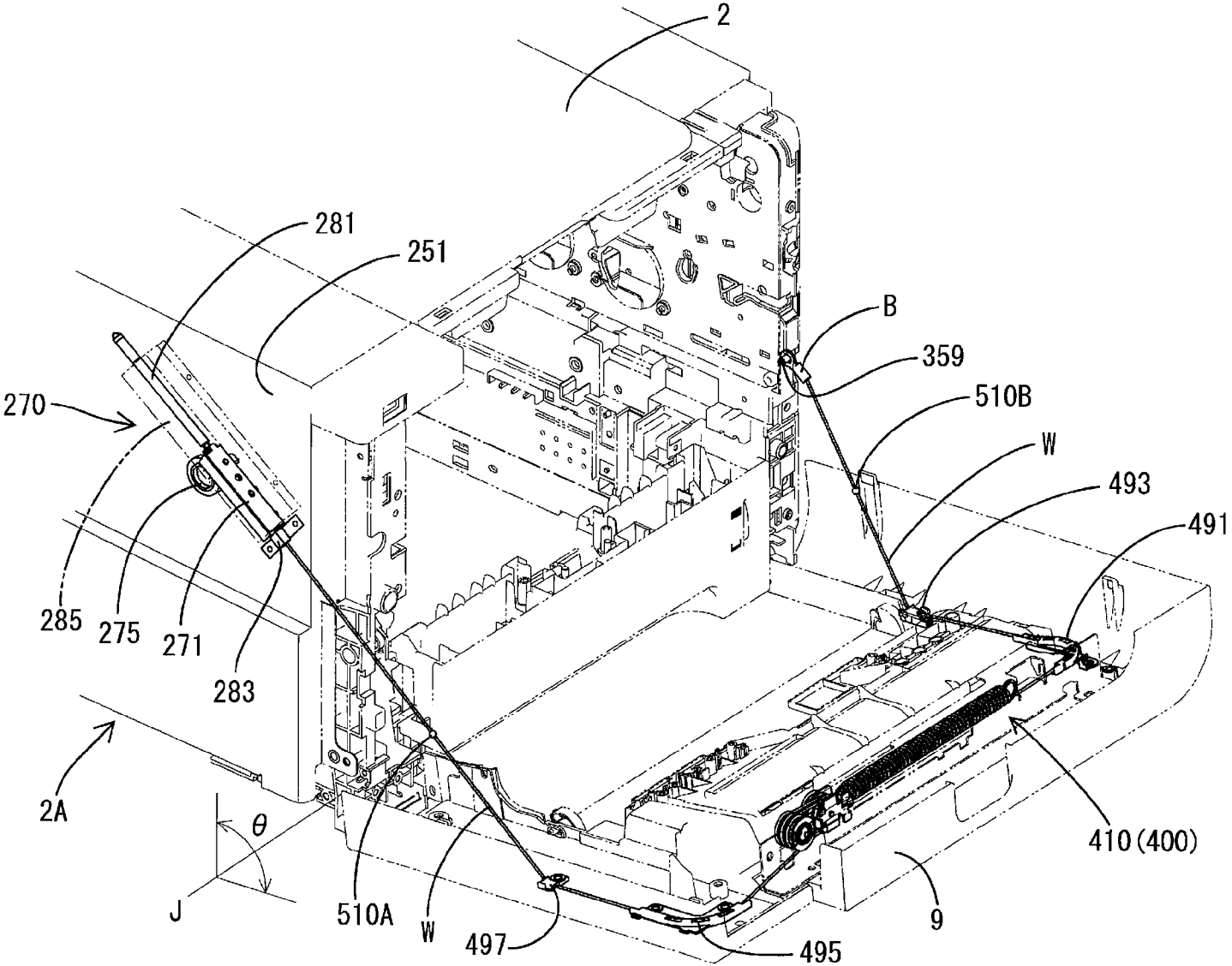
FIG. 3 is a perspective view of a laser printer with an opened front cover.

The front cover 9 is rotatable around the hinge shaft J provided in a lower portion of the front cover 9. The use of this hinge shaft J enables the front cover 9 to stand, as shown in FIG. 1, thereby closing the opening on the front surface of the main body casing 2 (hereinafter referred to as a closing posture) or enables the front cover 9 to tilt toward the front, as shown in FIG. 3, thereby opening the opening on the front surface of the main body casing 2 (hereinafter referred to as an opening posture). The opening angle of the front cover 9 is restricted by an opening restricting device Sd provided on the rear surface of the front cover 9 so that the opening angle does not exceed the angle θ shown in FIG. 3.

The opening on the front surface of the main body casing 2 serves as an attaching/detaching opening 8 communicating with a drum housing space 7 within the main body casing 2, and a drum unit Sa can be housed through this opening into the drum housing space 7 within the main body casing 2.

In the image forming apparatus in this illustrative aspect, a depressing and spacing device Sb and an air blowing device Sc (see FIG. 24) are incorporated in the main body casing 2. Once the drum unit Sa has been housed in the drum housing space 7 of the main body casing 2, these two devices Sb and Sc perform, at a prescribed timing, access actions corresponding to the functions of the devices to the drum unit Sa.

Although such access actions are important for activating functions of the printer, such as image formation, to exhibit themselves, they can provide hindrances or obstacles when the drum unit Sa is detached from the main body casing 2.

For this reason, as will be described later in detail, in this illustrative aspect, a synchronous relationship is given to both devices Sb and Sc of the depressing and spacing device Sb and the air blowing device Sc, which are provided on the main body casing 2 side, and the opening restricting device Sd, which is provided on the front cover 9. That is, when the opening operation of the front cover 9 in a closing position is performed, in synchronization with this, a first synchronous slider 271 that constitutes the depressing and spacing device Sb and a second synchronous slider 350 that constitutes the air blowing device Sc are drawn in by a wire W of the opening restricting device Sd to the front of the apparatus.

Then the two devices, the depressing and spacing device Sb and the air blowing device Sc, are moved to no longer have access to the drum unit Sa. As a result, the two devices can easily remove the drum unit Sa to outside the apparatus through the opening of the main body casing 2.

The drum unit Sa, the depressing and spacing device Sb, the air blowing device Sc and the opening restricting device Sd will be described in this order.

(A) Drum Unit

The drum unit Sa can include, for example, four development cartridges 27K to 27C, the unit frame 26, four drum subunits 28K to 28C and the like (see FIG. 2).

The development cartridge 27 is such that a toner is caused to be contained within the development frame 36. In the lower part of the development frame 36 are provided the supply roller 38 that delivers a toner to be incorporated and the developing roller 39.

Figure 4:
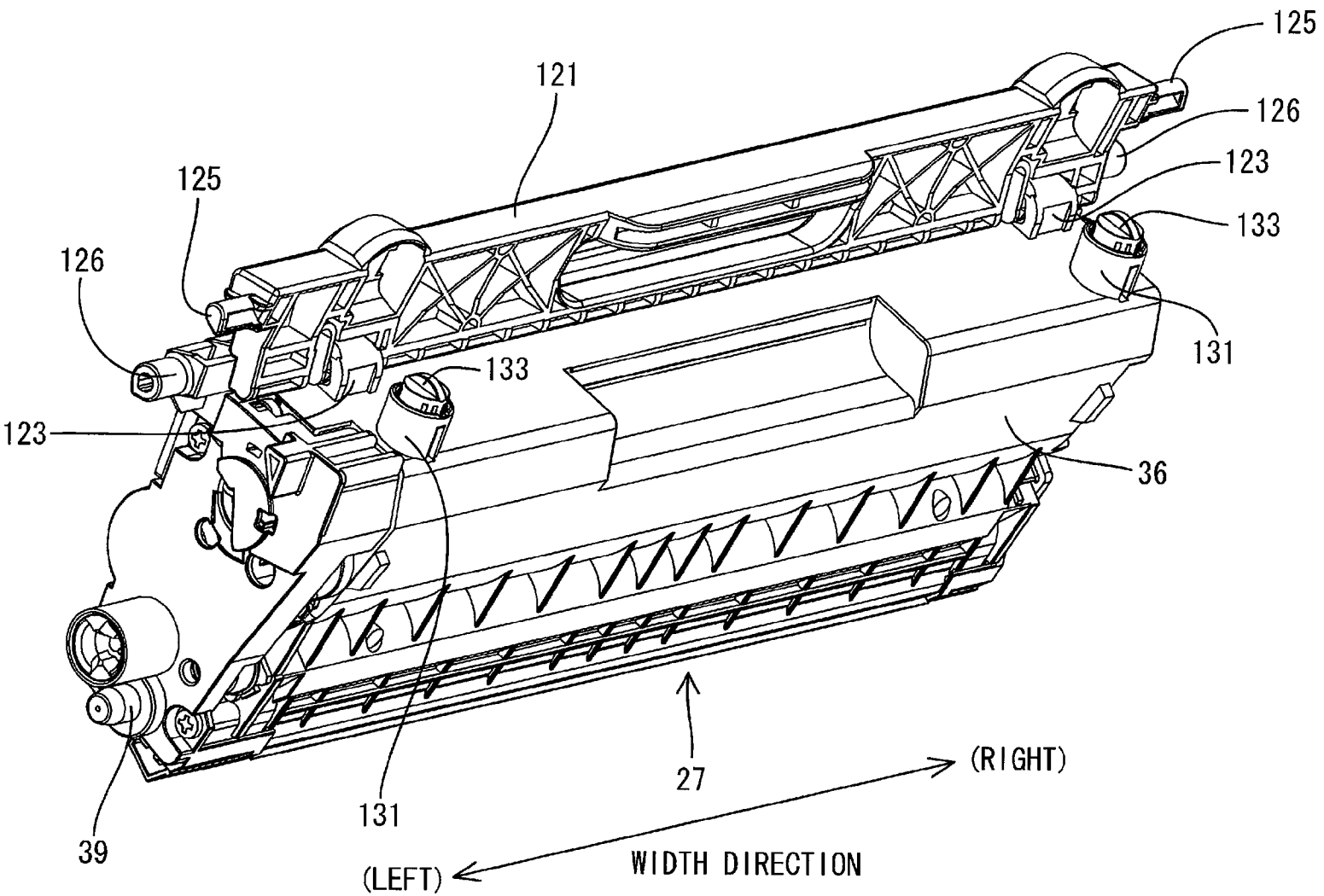
FIG. 4 is a perspective view of a development cartridge.

As shown in FIG. 4, the top surface of the development frame 36 is provided with a handle 121 for manipulation and a pair of abutting members 133.

The handle 121 can have a size that covers the whole width of the development cartridge 27 in the width direction, and can be rotatably connected to the development frame 36 via a supporting shaft 123.

The abutting members 133 are supported by cylindrical parts 131 provided in a latched condition at both end portions in the width direction. The cylindrical part 131 incorporates a coil spring 136, which biases the abutting member 133 upward. The top part of the abutting member 133 projects from the cylindrical part 131, and when the handle 121 is brought down, the bottom surface of the handle 121 abuts against the abutting member 133.

Figure 5:
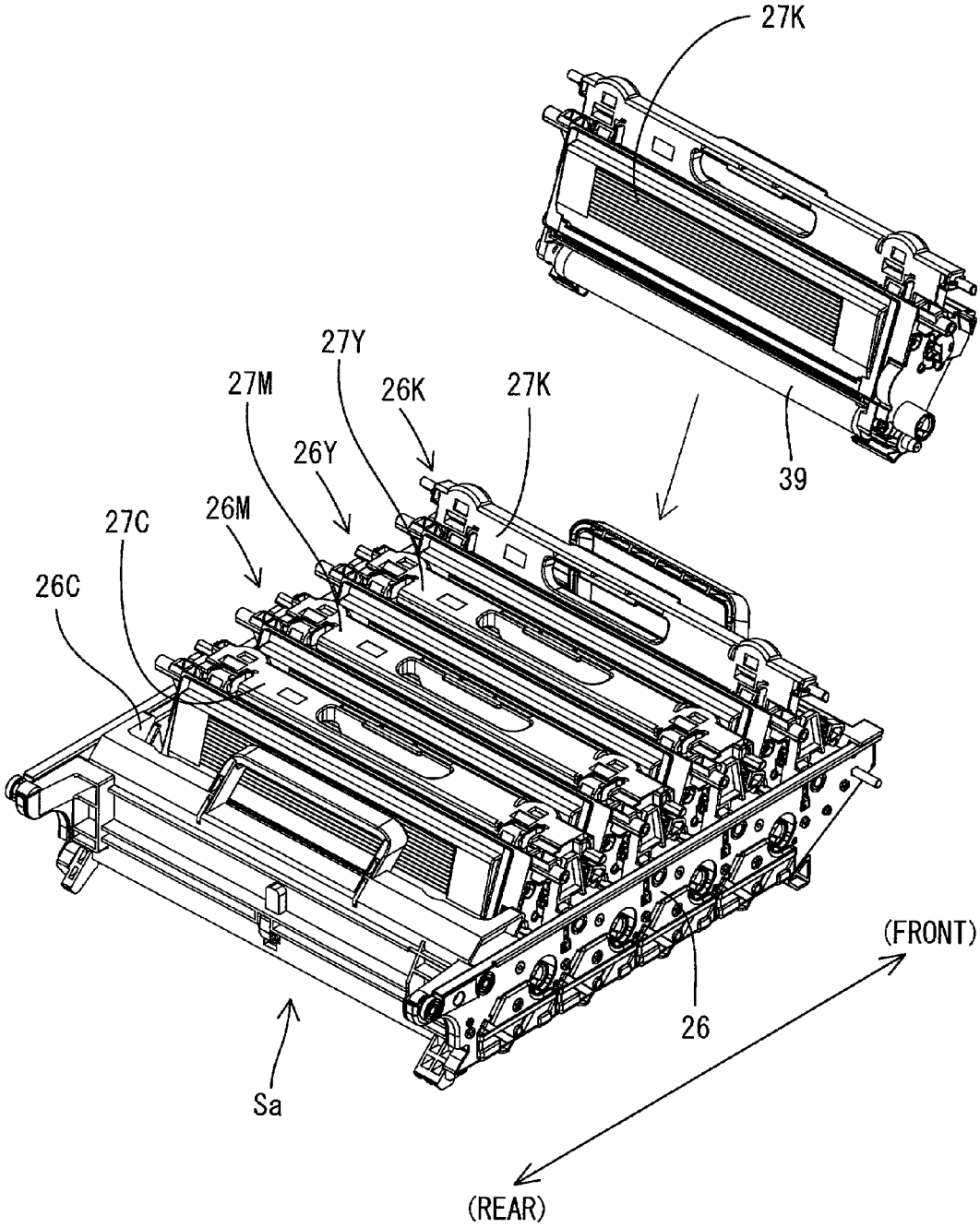
FIG. 5 is a perspective view of a drum unit.

As shown in FIG. 5, the unit frame 26 can include four cartridge housing portions 26K to 26C in the fore-and-aft directions of the apparatus so that development cartridges 27K to 27C of various colors can be housed therein or be drawn out of there by performing operations from above.

Figure 6:
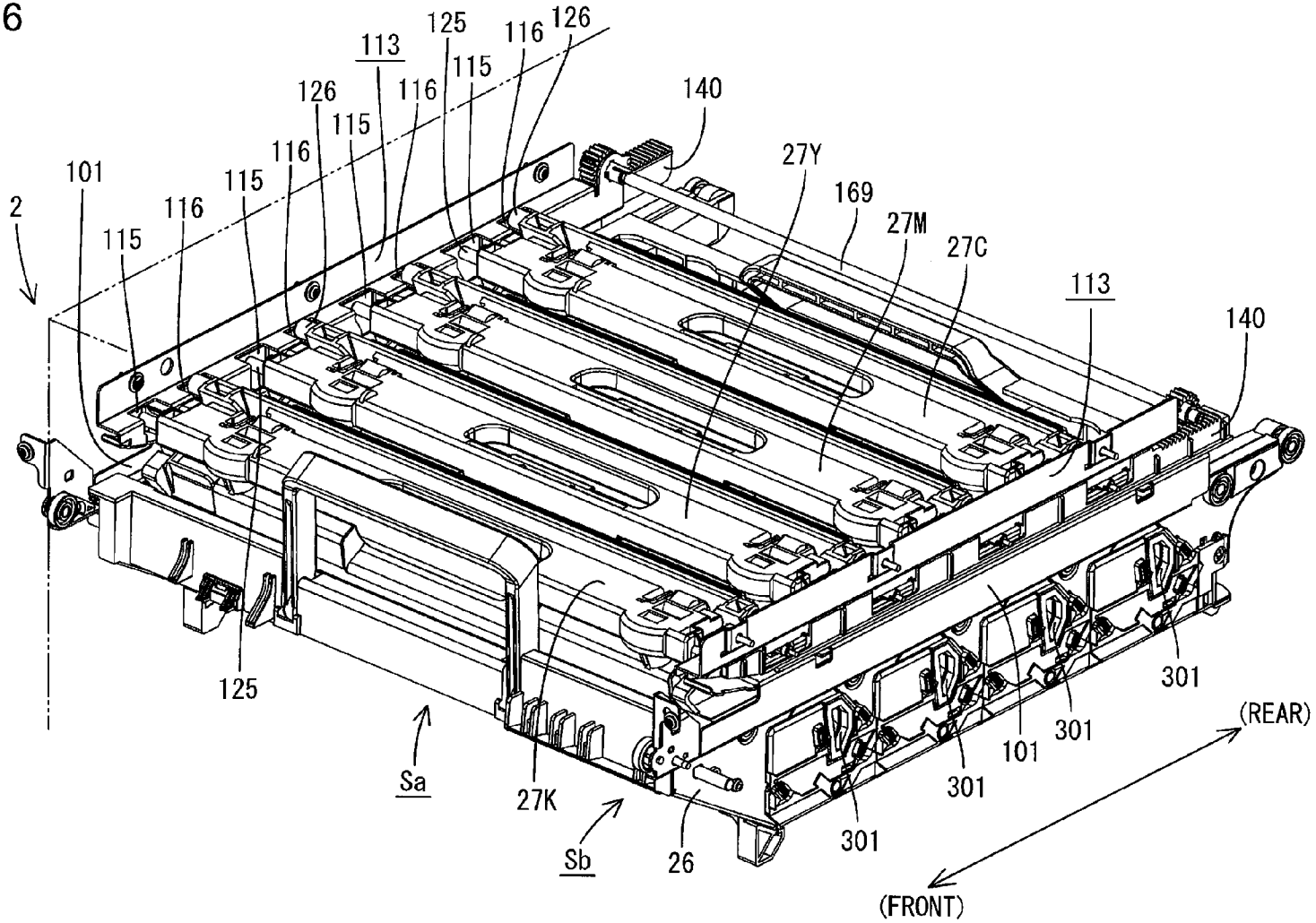
FIG. 6 is a perspective view showing the positional relationship between a depressing and spacing device and a drum unit.

As shown in FIG. 6, the above-described drum unit Sa is housed in a drum housing space 7 of the main body casing 2, with a horizontal posture thereof kept, by the guiding action of a set of rails 101 provided on the inner surface wall of the main body casing 2.

When the drum unit Sa is housed into the drum housing space 7 of the main body casing 2, with a horizontal posture thereof kept, the photosensitive drum 29 is moved toward the back side of the drum housing space 7 in a somewhat floating condition so that the photosensitive drum 29 does not come into contact with the sheet conveyance belt 58. Finally, the photosensitive drum 29 is able to descend a little so as to come into contact with the sheet conveyance belt 58 and is arranged in a condition that permits a printing action. When the drum unit Sa is drawn out of the drum housing space 7 toward the front side, firstly, the photosensitive drum 29 is raised a little so as not come into contact with the sheet conveyance belt 58 and is then moved from the drum housing space 7 toward the front side, with a horizontal position thereof kept.

(B) Depressing and Spacing Device Sb

The depressing and spacing device Sb has at least two functions. The first function is as follows. When the drum unit Sa has been housed into the drum housing space 7 of the main body casing 2, the development cartridge 27 is depressed downward, thereby bringing the developing roller 39 into contact with the photosensitive drum 29. By bringing the developing roller 39 into contact with the photosensitive drum 29 like this, it becomes possible to obtain a condition capable of image formation. The second function is to cancel the depressed condition of the development cartridge 27 by the above-described first function. The depressing and spacing device Sb will be described below.

Figure 7:
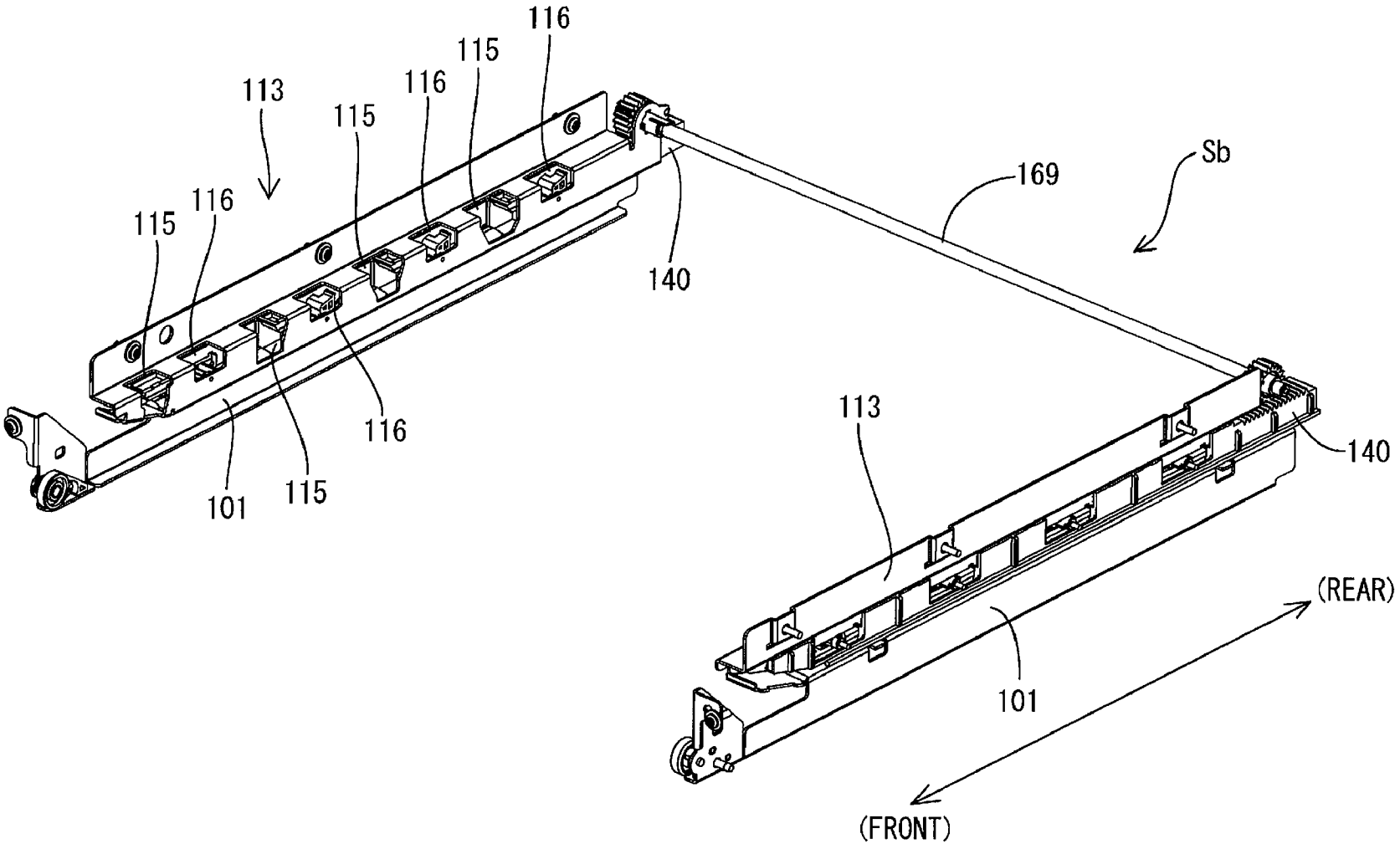
FIG. 7 is a perspective view of a depressing and spacing device.

FIG. 6 is a perspective view showing the positional relationship between the depressing and spacing device Sb and the drum unit Sa, and FIG. 7 is a perspective view of the depressing and spacing device Sb.

As shown in FIG. 6, on each of the two right and left side walls of the main body casing 2, there is provided a direct-acting cam member 140 having an elongated shape in the fore-and-aft directions, with the longitudinal direction thereof directed to the depth direction of the apparatus. On the inner surface of each of the two side walls of the main body casing 2, there is provided a cam holder 113, and the direct-acting cam member 140 is inserted into the cam holder 113 in a condition permitting forward and backward motions. The installation height of the direct-acting cam member 140 is a height corresponding to the upper portion of the drum unit Sa housed in the drum housing space 7, i.e., the upper portion of each of the development cartridges 27.

Figure 8:
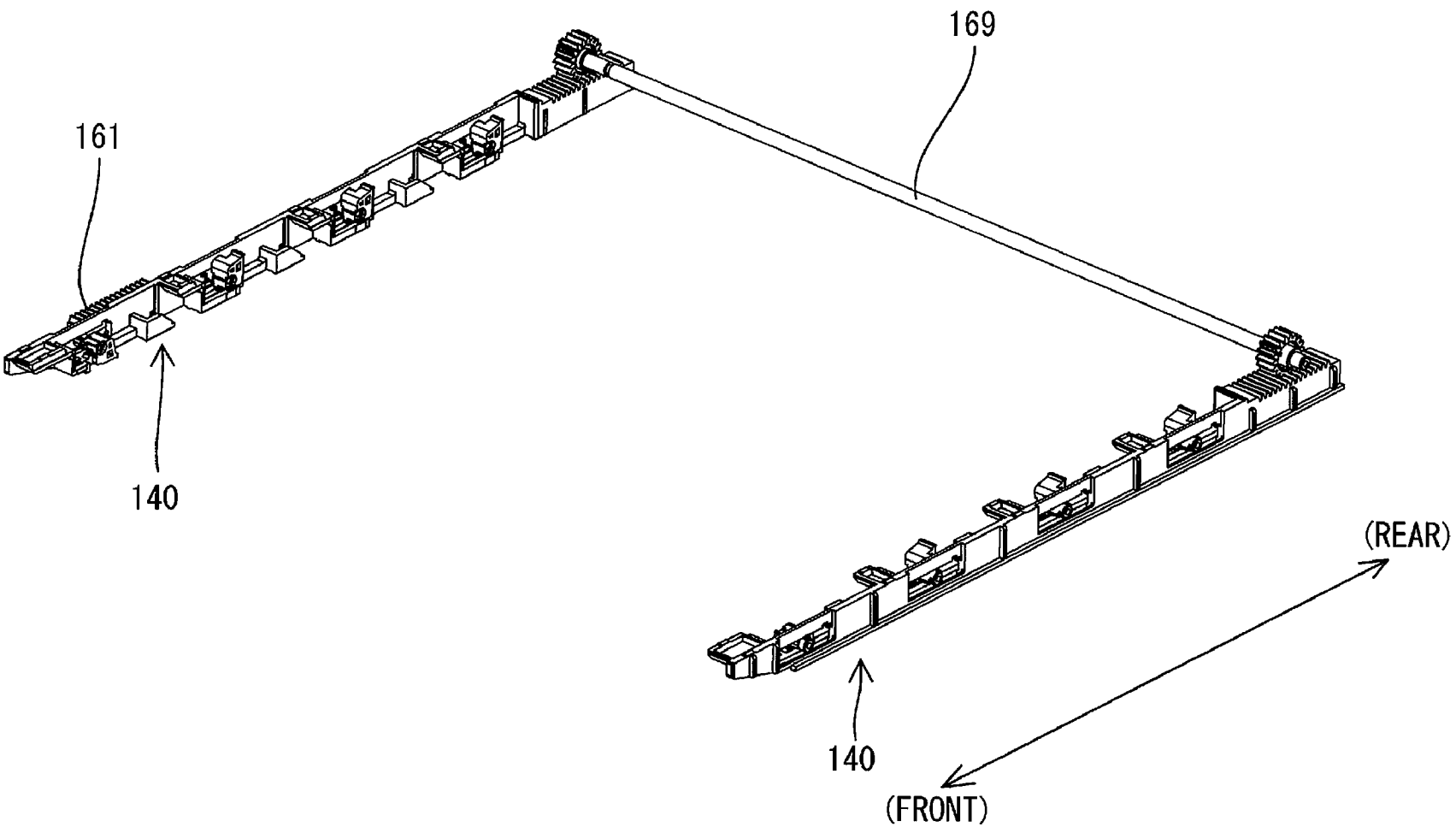
FIG. 8 is a perspective view of a direct-acting cam member.

The reference numeral 169 shown in FIG. 6 to FIG. 8 denotes a connecting shaft. The connecting shaft 169 connects tail ends of the two direct-acting cam members 140 and has the function of causing a driving force to be transmitted. Concretely, the direct-acting cam member 140 in the left-hand back side in FIG. 8 is the main side, and the direct-acting cam member 140 on the right-hand front side is the sub-side.

The direct-acting cam member 140 on the main side moves forward and backward, the forward and backward motions on the main side are transmitted to the direct-acting cam member 140 on the sub-side via the connecting shaft 169, and the direct-acting cam member 140 on the sub-side moves forward and backward in synchronization with the direct-acting cam member 140 on the main side. Though, in the transmission of the driving force by the connecting shaft 169, as shown in FIG. 8, the power is transmitted by using the gear engagement by a rack gear and a pinion gear.

And by the forward and backward motions of the direct-acting cam member 140, a depressing protrusion 125, which will be described below, is depressed downward or a spacing protrusion 126, which will be described below, is pushed up.

As shown in FIG. 4, on both sides of each of the development cartridges 27, two protrusions 125, 126 are provided each in two upper and lower portions. The upper protrusions are the depressing protrusions 125. The depressing protrusions 125 are provided as a pair on free ends of the handle 121, and these depressing protrusions 125 protrude outward. The lower protrusions are the spacing protrusions 126. The spacing protrusions 126 are provided as a pair on of the upper wall of the development frame 36, and these spacing protrusions 126 are formed so as to protrude outward.

Corresponding to the above-described protrusions 125, 126, as shown in FIG. 7, on the top surface of the cam holder 113 of the depressing and spacing device Sb, four sets of a first communication hole 115 and a second communication hole 116 are longitudinally provided by being spaced from each other. The reason why four sets are formed is that the two protrusions 125, 126 are formed in each of the four development cartridges 27C to 27K, and that the two communication holes 115, 116 are provided so as to correspond to these protrusions 125, 126.

Figure 9:
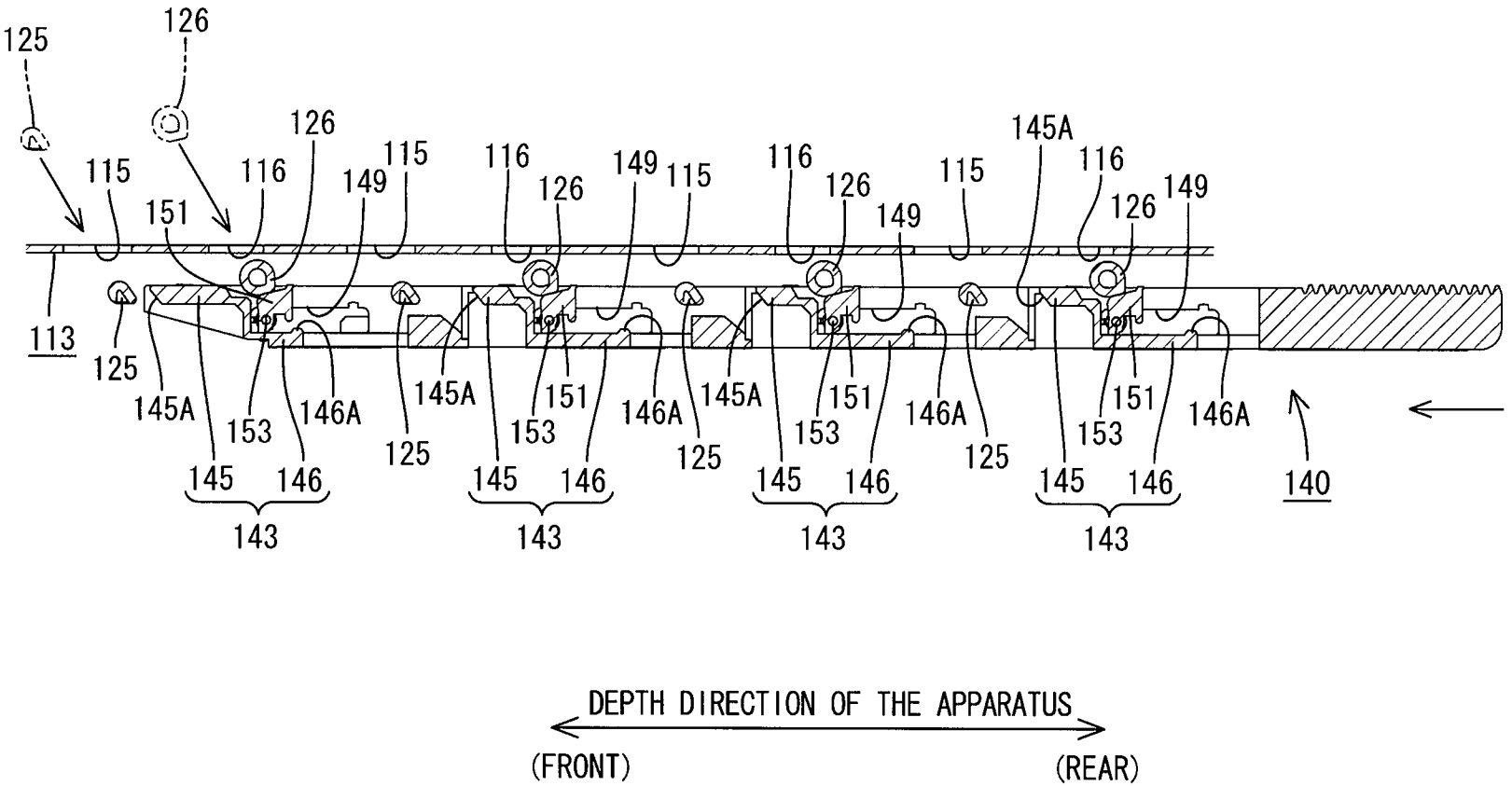
FIG. 9 is a diagram showing a disengaging position of a direct-acting cam member.
Figure 10:
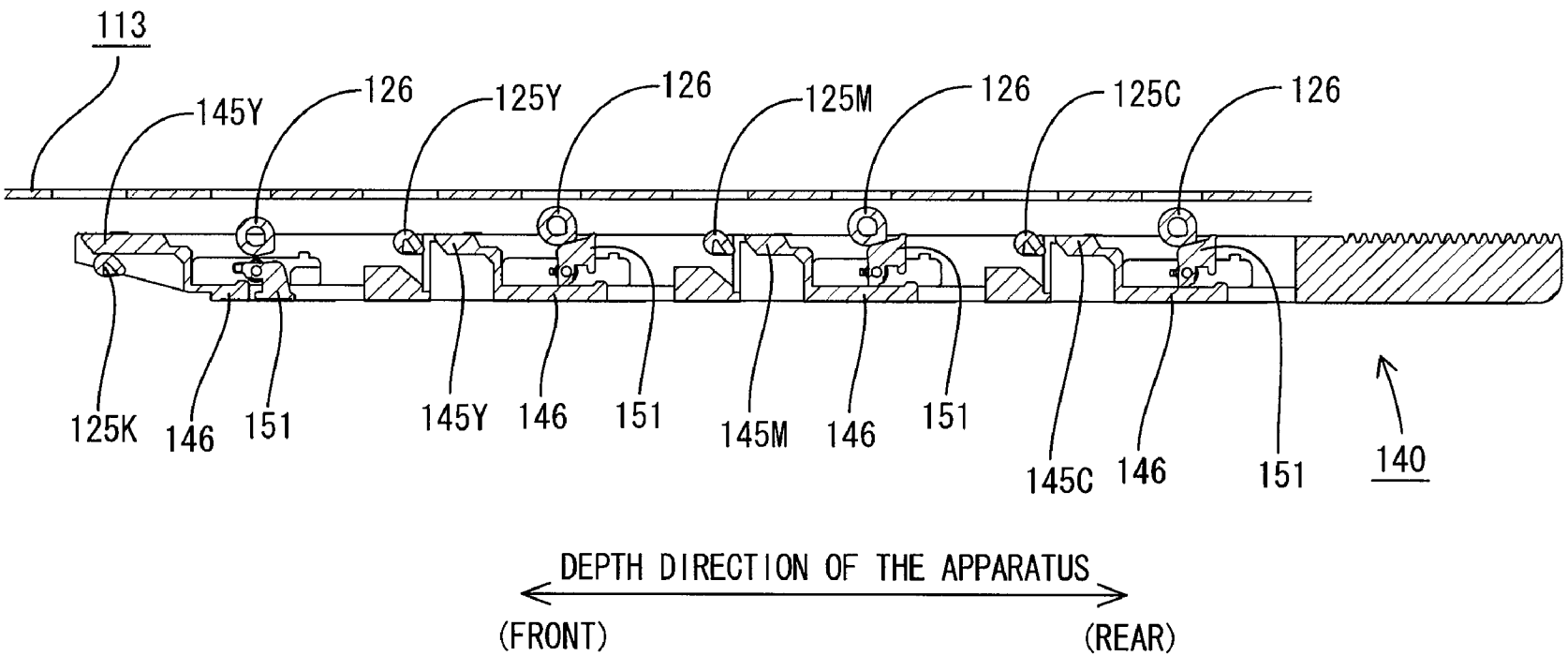
FIG. 10 is a diagram showing an intermediate position of a direct-acting cam member.

Next, the shape of the direct-acting cam member 140 will be described by taking the direct-acting cam member 140 on the main side as an example. As shown in FIG. 9, the direct-acting cam member 140 has a shape elongated in one direction and is provided with four working portions 143 in the longitudinal direction. Each of the working portions 143 is provided at prescribed intervals (for example, the intervals correspond to the arrangement intervals of the development cartridges 27K to 27C), and is constituted by a working portion for depression 145 and a working portion for connection/separation 146.

The working portion for depression 145 has a shape that is horizontally elongated in the left-hand direction in FIG. 9 and a taper 145A is formed at the leading end thereof. The taper 145A is formed to have a shape obtained by cutting off the lower part of the leading end of the working portion for depression 145 on the slant.

On the other hand, the working portion for connection/separation 146 has a shape that is horizontally elongated in the right-hand direction in the figure, and a protrusion 146A that overhangs upward as shown in the figure. The working portion for connection/separation 146 is intended for rotating a rotary pushup member 151 in synchronization with the forward and backward motions of the direct-acting cam member 140.

The rotary pushup member 151 is rotatably supported by a supporting shaft 153 fixed to the main body casing 2. On the other hand, an escape hole 149 through which the supporting shaft 153 is inserted is opened in the direct-acting cam member 140, and the direct-acting cam member 140 can move independently of the fixed rotary pushup member 151.

As a result of this, rotary pushup member 151 performs only a rotary motion in situ (in a fixed position) without performing a sliding motion as one piece in association with the forward and backward motions of the direct-acting cam member 140.

The rotary pushup member 151 corresponds to the spacing protrusion 126 of each of the development cartridges 27 and the installation position of all of the rotary pushup members 151 is in the vicinity just under the second communication hole 116.

Figure 11:
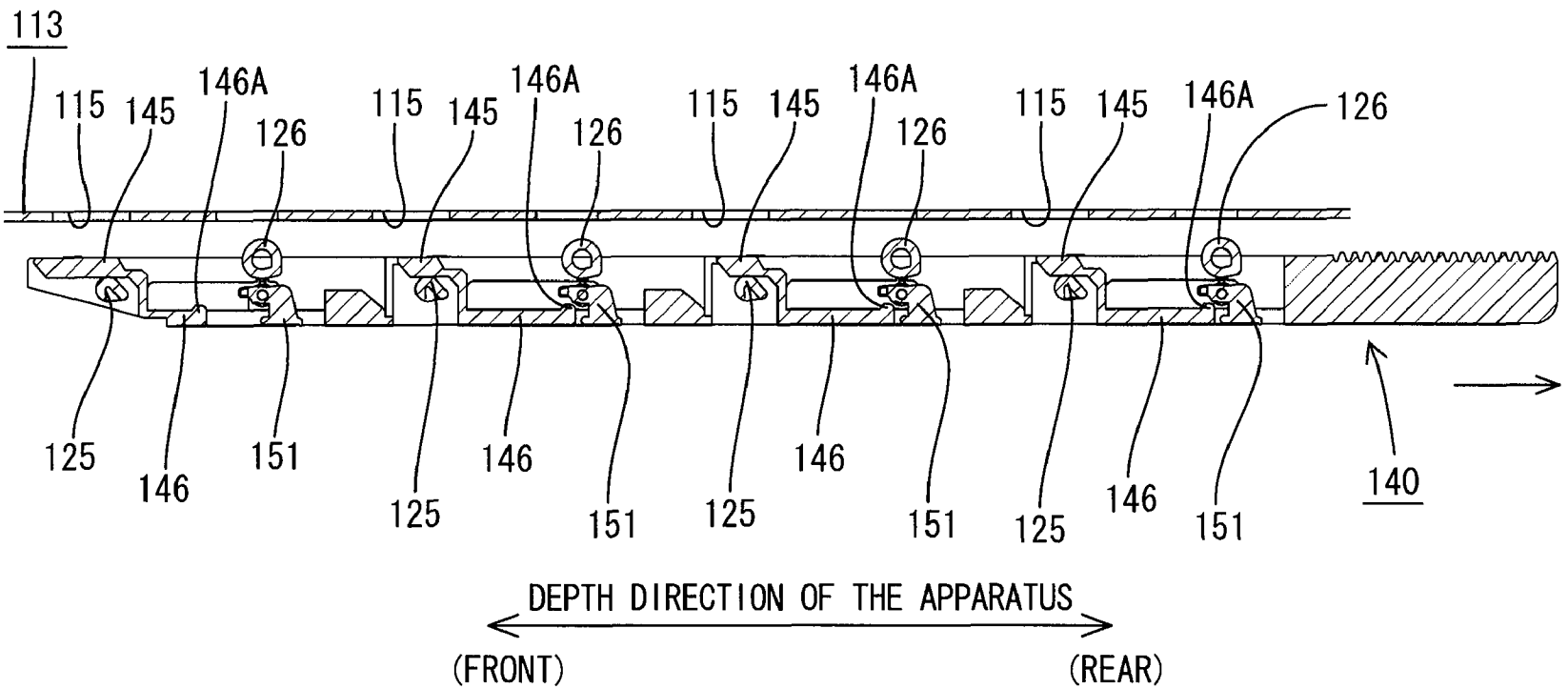
FIG. 11 is a diagram showing a depressing position of a direct-acting cam member.
Figure 12:
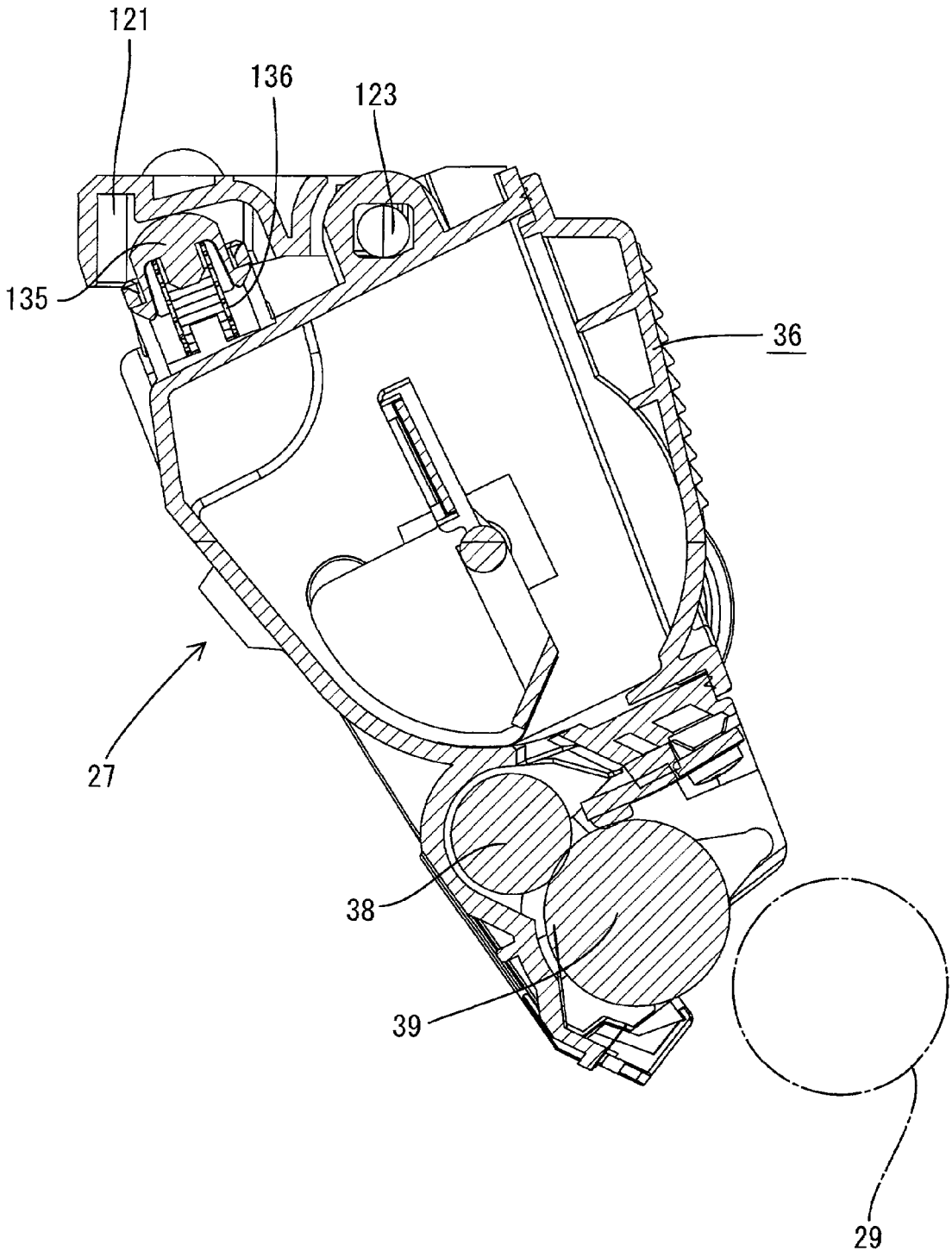
FIG. 12 is a vertical sectional view of a development cartridge.
Figure 13:
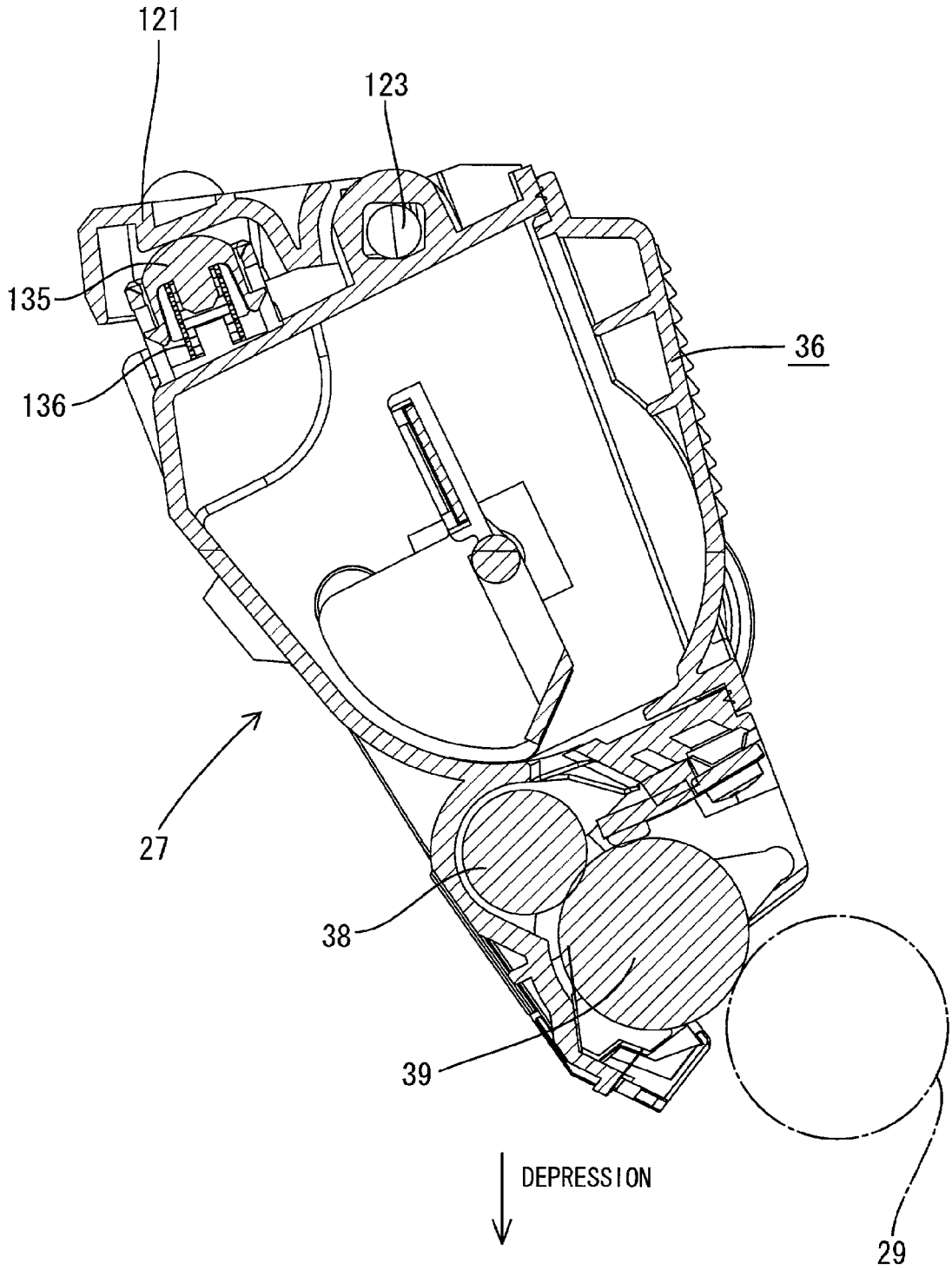
FIG. 13 is a vertical sectional view of a development cartridge (when pushed to below the apparatus)

This direct-acting cam member 140 can perform reciprocating straight-line motions between the disengaging position shown in FIG. 9 and the depressing position shown in FIG. 11.

With the direct-acting cam member 140 present in a disengaging position, behind the first communication hole 115 (the right-hand side in FIG. 9) the working portion for depression 145 opens the first communication hole 115.

For this reason, when the drum unit Sa has been housed in the drum housing space 7, as indicated by the arrows in FIG. 9, each of the depressing protrusions 125 enters the interior of the cam holder 113 through the corresponding first communication hole 115, and the depressing protrusion 125 and the working portion for depression 145 come into a face-to-face condition, spaced from each other at a prescribed distance in the horizontal direction.

The spacing protrusion 126 enters the interior of the cam holder 113 through the second communication hole 116 and abuts against the top of the rear surface of the rotary pushup member 151.

When the direct-acting cam member 140 is moved from this condition toward a depressing position in the left-hand direction indicated in the figure (the front side of the main body of the apparatus), during this process of movement the working portion for depression 145 abuts against the depressing protrusion 125.

After that, by the guiding action of the taper 145A, the working portion for depression 145 moves onto the depressing protrusion 125 while pushing down the depressing protrusion 125, and when the direct-acting cam member 140 has reached the depressing position shown in FIG. 11, the depressing protrusion 125 is already under the working portion for depression 145.

As described above, in the process of the movement of the direct-acting cam member 140 from a disengaging position to a depressing position, the working portion for depression 145 pushes down the depressing protrusion 125, and eventually the handle 121. For this reason, the whole development cartridge 27 is pushed downward, with the coil spring 136 shrunk, and as a result that the developing roller 39 of the development cartridge 27 comes into elastic contact with the photosensitive drum 29 (see FIGS. 12 and 13: depressing action). This depressing action is the access action described earlier.

As shown in FIG. 11, when the direct-acting cam member 140 has reached a depressing position, the working portion for depression 145 stops up the first communication hole 115 and the depressing protrusion 125 comes into a latched condition. For this reason, in order to remove the development cartridge 27 and eventually the drum unit Sa from the drum housing space 7 of the main body casing 2, it is necessary to move the direct-acting cam member 140 again from a depressing position to a disengaging position.

The above-described construction realizes the feature of the present invention that "a movable member (direct-acting cam member 140) is moved to a depressing position, each of the working portions for depression 145 is caused to engage with (abut against) each of the developing devices (depressing protrusion 125 of the development cartridge 27), and this engagement (abutment) enables each of the developer carrying members (developing rollers 39) that constitute the developing device (development cartridge 27) to be depressed onto each of the image carrying members (photosensitive drums 29) corresponding to the developer carrying member (developing rollers 39)".

In this illustrative aspect, the four depressing protrusions 125 are provided so as to correspond to the four development cartridges 27K to 27C. However, the depressing protrusion 125K corresponding to the "black" development cartridge 27K, for example, is pressed to the working portion for depression 145K at a timing earlier than the remaining depressing protrusions 125Y to 125C (in an intermediate position from a disengaging position to a depressing position) (see FIG. 10).

This may be the result of black-and-white printing, so that only that the developing roller 39 corresponding to the color black be brought into contact with the photosensitive drum 29 corresponding to this developing roller 39 and because it is unnecessary to bring this developing roller 39 into contact with the photosensitive drums 29 of other colors.

Next, the spacing action will be described. When the direct-acting cam member 140 is caused to slide from the depressing position shown in FIG. 11 to the disengaging position shown in FIG. 9, the engagement between the depressing protrusion 125 and the working portion for depression 145 becomes undone. On the other hand, the protrusion 146A of the working portion for connection/separation 146 abuts against the rotary pushup member 151, thereby rotating the rotary pushup member 151 counterclockwise.

Because of this, the rear surface of the rotary pushup member 151 abuts against the lower surface of the spacing protrusion 126 and pushes up the spacing protrusion 126. As a result of this, an upward force acts on each of the development cartridges 27K to 27C via each of the spacing protrusions 126 and thus each of the development cartridges 27 is capable of floating a little from the unit frame 26.

When the drum unit Sa is later taken out of the drum housing space 7, performing a spacing action as described above enables each of the development cartridges 27K to 27C to be easily taken out of the taken-out drum unit Sa.

One example of a means for direct-acting cam member 140 to perform reciprocating direct-line movement between a disengaging position and a depressing position, is a drive source. In the driving source of this illustrative aspect, two driving systems are provided as the driving system: an electric motor-driven, first driving system 210 and a second driving system 250 using manual opening and closing motions of the front cover 9. These two driving systems 210, 250 are changed over in synchronization with the opening and closing of the front cover 9. That is, the first driving system 210 is in a connected condition while the front cover 9 is in a closing posture. However, once the opening operation of the front cover 9 has been performed, the first driving system 210 becomes disconnected at an initial stage of the opening operation and the second driving system 250 becomes connected thereafter.

One reason why two driving systems are beneficial is that even when the power is turned off at an unexpected timing and the first driving system 210 cannot be used any more, the direct-acting cam member 140 is able to be moved by the second driving system.

To sum up, the direct-acting cam member 140 is constantly held in a depressing position during image formation, because image formation is impaired unless the photosensitive drum 29 and the developing roller 39 are kept in a close contact condition. If, for example, a sheet jam occurs and the power is turned off during image formation in order to take out the sheet that has been involved in the sheet jam, the first driving system 210 will stop. In a case where only the first driving system 210 is provided, the direct-acting cam member 140 cannot inevitably move and the direct-acting cam member 140 becomes held in a depressing position.

Under these circumstances, even if the opening on the front surface of the main body casing 2 is opened by operating the front cover 9, the drum unit Sa is still in a condition latched by the direct-acting cam member 140; therefore, replacement of each of the development cartridges 27K to 27C is still restricted. The second driving system 250 is provided in order to prevent this situation from occurring. The two driving systems 210, 250 will be described below.

Figure 14:
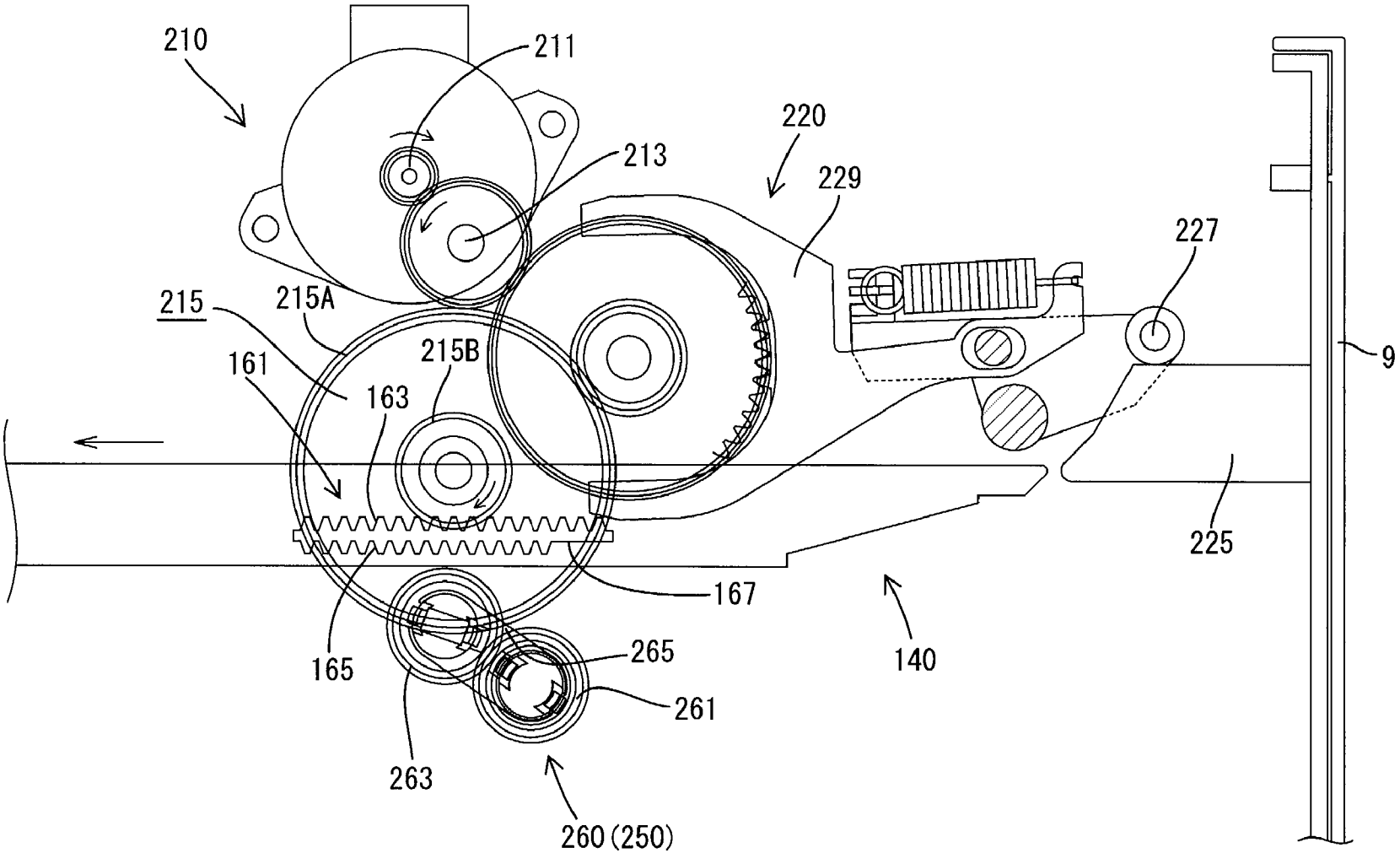
FIG. 14 is a diagram showing the connection condition of driving systems (a first driving system is connected and a second driving system is disconnected)

As shown in FIG. 14, a power input plate 161 is fixed to a side surface of the direct-acting cam member 140. The power input plate 161 has a shape elongated in one direction as with the direct-acting cam member 140, and gears 163, 165 are formed on both upper and lower surfaces thereof. The first driving system 210 is formed by a group of gears formed above the power input plate 161, and the second driving system 250 is formed by a group of gears formed below the power input plate 161.

The first driving system 210 is constituted by a motor M as the driving source, a motor gear 211, a motor-side transmission gear 213, a direct-acting cam side transmission gear 215, and a clutch mechanism 220. The direct-acting cam side transmission gear 215 is such that a large gear 215A meshing with a clutch gear constituting the clutch mechanism 220 and a small gear 215B meshing with the upper gear 163 of the power input plate 161 are integrally provided.

The clutch mechanism 220 is intended for performing control for obtaining either a connected condition in which the driving force of the motor M is transmitted to the direct-acting cam side transmission gear 215 or a disconnected condition in which the connection is cut. To give a brief description, as shown in FIG. 14, a U-shaped plate 229 is pushed in the meshing direction (the left side in the figure) when the front cover 9 is in a closing posture, thereby causing the gears to mesh with each other and permitting the transmission of power.

As is apparent from the foregoing, when the motor M has been driven, with the front cover 9 kept in a closing posture, the driving force is input to the gear 163 of the power input plate 161 via the route: motor gear 211, motor-side transmission gear 213, clutch mechanism 220, direct-acting cam side transmission gear 215. As a result of this, a horizontal force acts on the power input plate 161 and causes the direct-acting cam member 140, along with the power input plate 161, to perform reciprocating straight-line movement in the horizontal direction.

Figure 15:
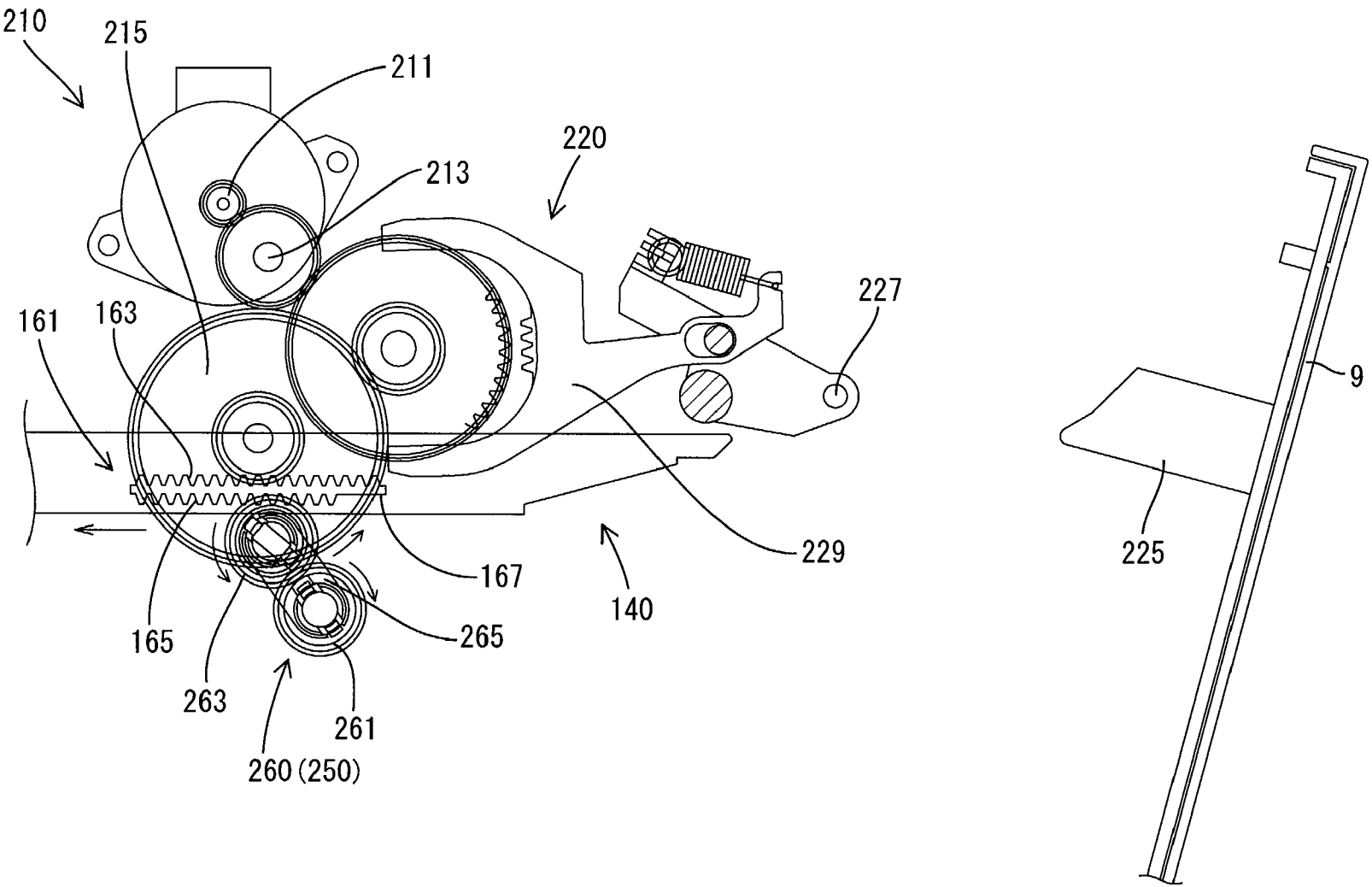
FIG. 15 is a diagram showing that a changeover of the driving systems has been performed.

On the other hand, when the opening operation of the front cover 9 has been performed, at the initial stage of the operation a supporting plate 225 provided in the front cover 9 undoes the support of a pin 227 from below as shown in FIG. 15, whereby also the depressing of the U-shaped plate 229 is disengaged. Because the gear meshing becomes disengaged, power cannot be transmitted.

Next, the second driving system 250 will be described.

The second driving system 250 is constituted by a gearing 260 and a linkage device 270 that drives the gearing 260 in cooperation with the opening operation of the front cover 9 (see FIGS. 3, 14, 17 and 19).

As shown in FIG. 3, the whole top portion of the outer surface of the left-hand wall 2A of the main body casing 2 is depressed to the inner side of the apparatus and this portion serves as an installation portion 251. The installation portion 251 includes the linkage portion 270. The linkage portion 270 is constituted by the first synchronous slider 271 and a pinion gear 275 that forms a pair with this first synchronous slider 271. The first synchronous slider 271 is attached to the installation portion 251 via the holder 285 in a slant manner.

Figure 17:
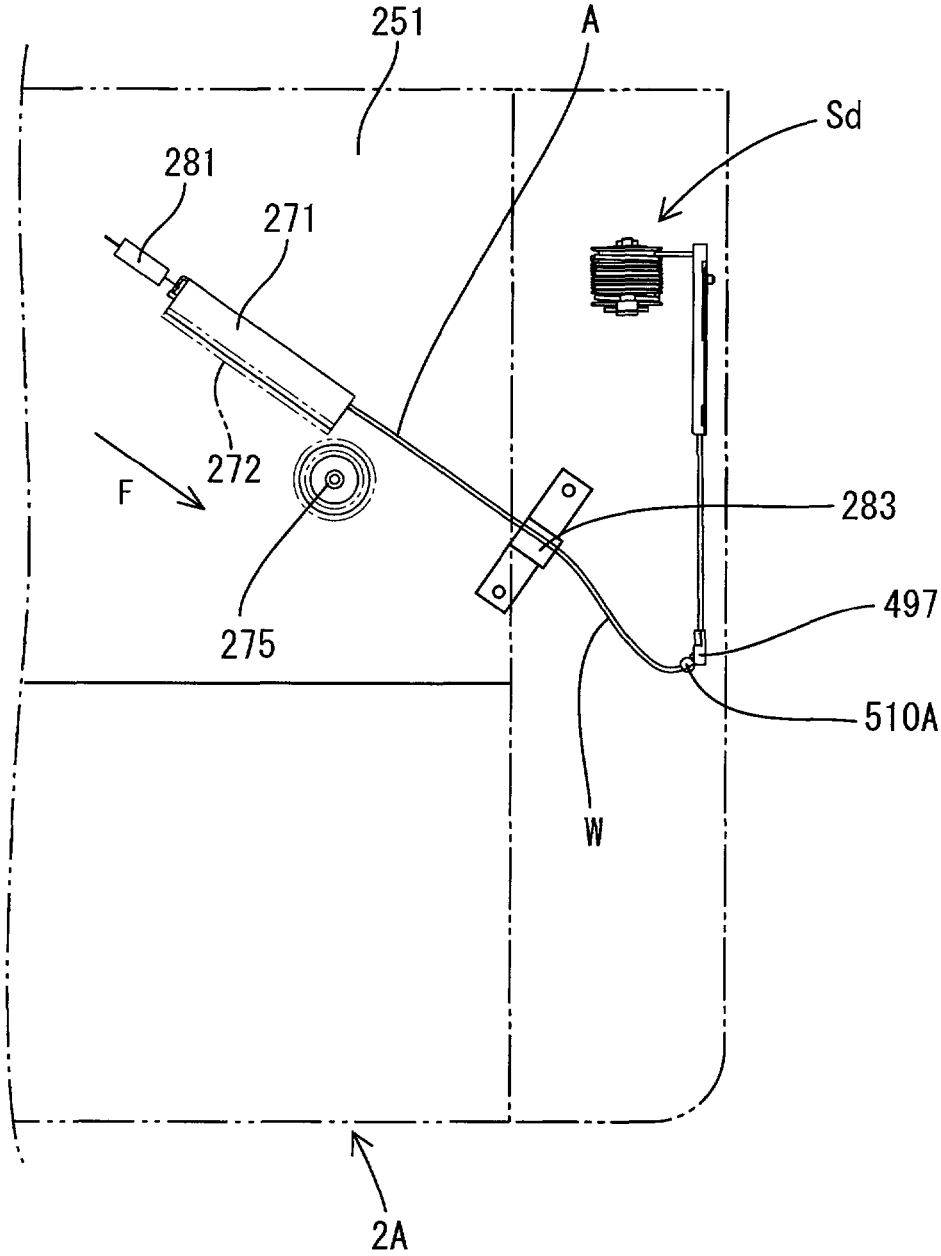
FIG. 17 is a diagram showing the initial position of a first synchronous slider.

As shown in FIG. 17, the first synchronous slider 271 has a shape that is elongated in one direction, and a toothed portion 272 is provided in the lower part of the first synchronous slider 271. An biasing coil spring 281 is provided behind the first synchronous slider 271 and draws in the first synchronous slider 271 to the initial position shown in FIG. 17. The pinion gear 275 is provided before the first synchronous slider 271 thereunder and at a prescribed distance therefrom.

An end A of a wire W is fixed to the front end of the first synchronous slider 271. The first synchronous slider 271 is drawn to the front of the apparatus via the wire W in synchronization with the opening operation of the front cover 9. As a result of this, the first synchronous slider 271 moves in the direction indicated by the arrow F in FIG. 17 along the holder 285 while elongating the coil spring 281.

During this movement, the toothed portion 272 of the first synchronous slider 271 and the toothed portion of the pinion gear 275 mesh with each other, thereby rotating the pinion gear 275.

Figure 19:
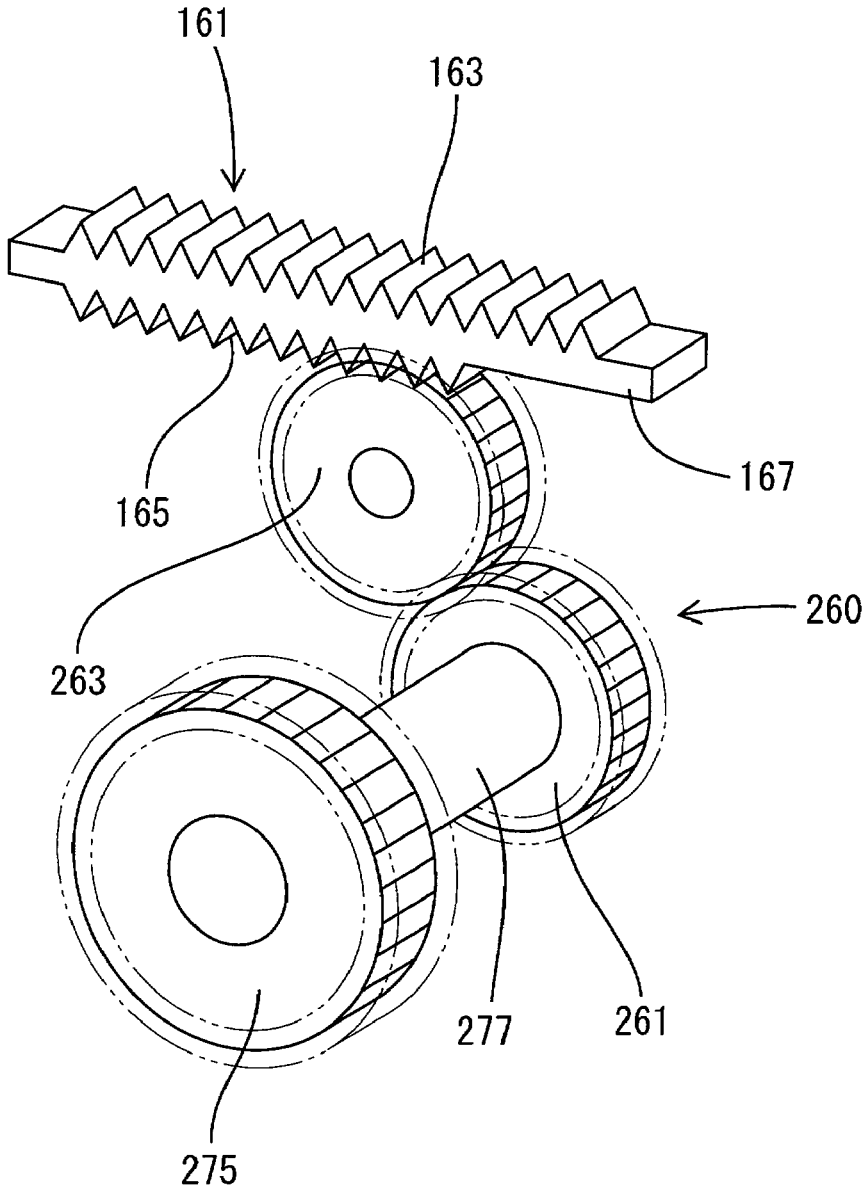
FIG. 19 is a diagram that shows how a pinion gear and a sun gear are connected by a shaft.

As shown in FIG. 19, the pinion gear 275 is connected by a center gear 261 and a shaft 277 of the gearing 260. For this reason, when the pinion gear 275 rotates, the center gear 261 rotates as one piece with the pinion gear 275.

A slider stopper 283 is provided on the front side of the first synchronous slider 271 in the travel direction. When the slider 271 has reached the stop position shown in FIG. 18 after the movement over a predetermined stroke, the front end of the first synchronous slider 271 abuts against the slider stopper 283 and a further forward motion is restricted.

The tension acting on the wire W is efficiently transmitted to the slider 271, which is a result of the first synchronous slider 271 positioned in a slant manner and moveable in a slant manner.

Referring again to FIG. 14, the gearing 260 will be described. The gearing 260 functions as a clutch and is provided with a constant-position gear 261 and a swivel gear 263 that mesh with each other, and a swivel arm 265. The swivel arm 265 is intended for supporting the swivel gear 263 so as to oscillate the swivel gear 263 around the constant-position gear 261. The swivel arms 265 base end is rotatably supported by a rotating shaft of the constant-position gear 261 with an appropriate frictional resistance and holds the swivel gear 263 on another end in a rotatable condition.

The swivel arm 265 has an inclined posture as shown in FIG. 14 and holds the swivel gear 263 in a condition spaced from the power input plate 161, resulting in the second driving system 250 being cut off from the transmission of power.

However, when the first synchronous slider 271 slides from an initial position toward a stop position in association with the opening of the front cover 9 and the pinion gear 275 has rotated, the constant-position gear 261 rotates and causes the swivel arm 265 to swing.

Because of this, the swivel gear 263 is lifted up as shown in the figure and abuts against the lower gear 165 of the power input plate 261. As a result of this, both gears 165, 263 mesh with each other, permitting the transmission of power.

After the meshing of both gears 165, 263, the first synchronous slider 271 is further drawn in toward the stop position by further tilting the front cover 9, the swivel gear 263 rotates, and swivel gear 263 meshes with the gear 165 as shown in FIG. 15. Because of this, a horizontal force acts on the power input plate 161 and moves the direct-acting cam member 140, horizontally along with the power input plate 161, in the disengaging direction (the left direction in FIG. 15).

As shown in FIG. 14, a portion without a tooth 167 is formed in the tail end portion (the right side in FIG. 14) of the gear 165 corresponding to the second driving system 250 in the direct-acting cam member 140. One purpose for installation of the second diving system 250 is to move the direct-acting cam member 140 to the disengaging position in synchronization with the opening when the opening operation of the front cover 9 is performed, with the direct-acting cam member 140 present in a depressing position.

Therefore, when the direct-acting cam member 140 is in a disengaging position at the stage of opening the front cover 9, it is unnecessary to cause the direct-acting cam member 140 to slide by use of the second driving system 250. In this case, the swivel gear 263 is brought into a freewheeling condition by the portion without a tooth 167 so that the transmission of power by the second driving system 250 is cancelled.

(C) Air Blowing Device Sc

The air blowing device Sc is intended for circulating the air within the drum unit Sa and, particularly, around the charging device 30. If the air is not circulated, pollutants and dust generated during the charging of the photosensitive drum 29 accumulate in the interior and this causes a decrease in image quality. Therefore, the area around the charging device is kept clean by circulating the air, thereby preventing a decrease in image quality.

Four charging devices 30 are provided within the drum unit Sa, and each can correspond to different colors. Therefore, on the side surface of the unit frame 26 are provided with four intake ports 301 side by side in positions corresponding to each of the charging devices 30.

Figure 20:
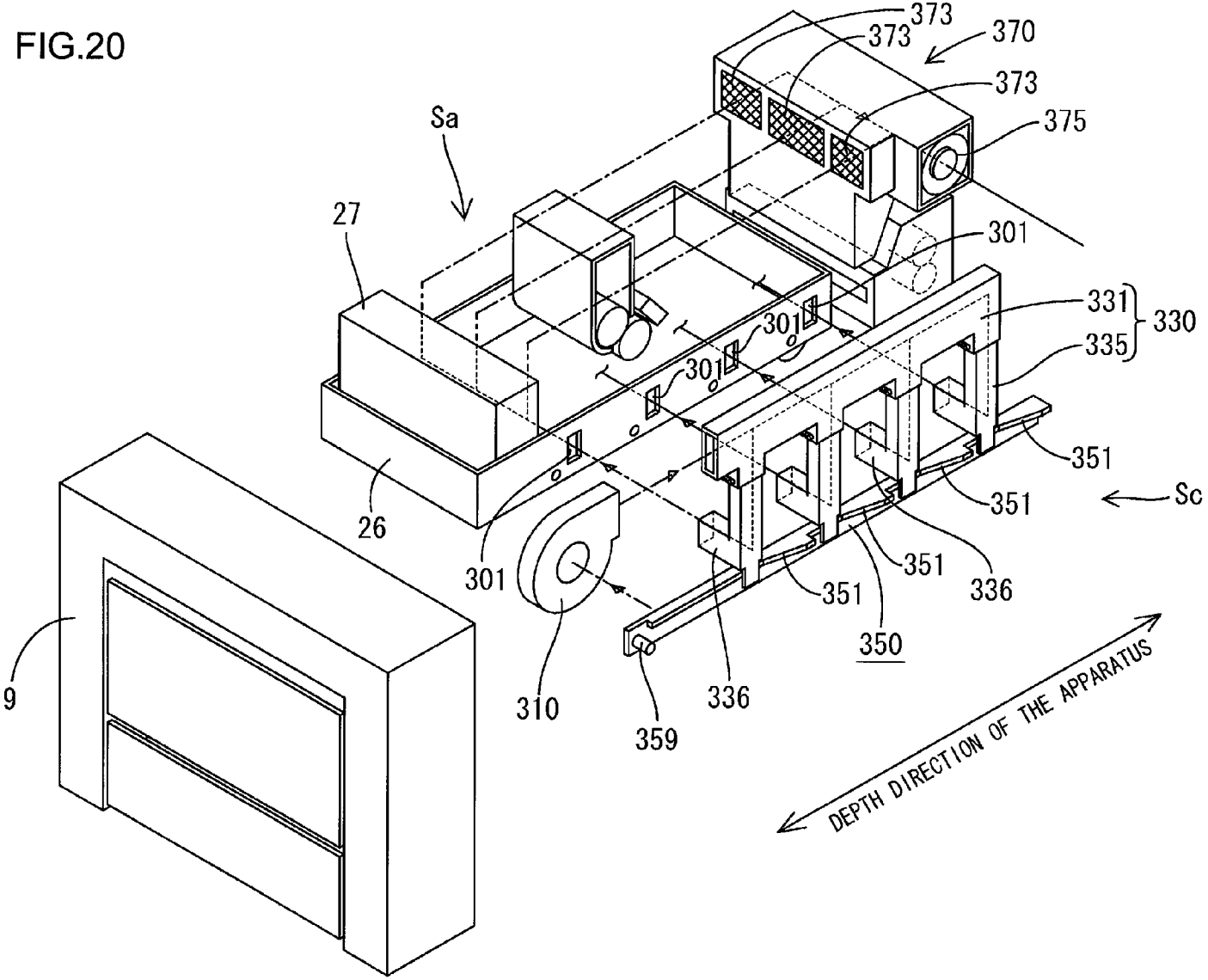
FIG. 20 is a perspective view showing the general construction of an air blowing device.

FIG. 20 is an exploded perspective view showing the construction of the air blowing device Sc. The reference numeral 310 shown in the figure denotes an air blower, the reference numeral 330 denotes an air blowing duct, and the reference numeral 370 denotes an exhaust unit. A rough construction of the air blowing device Sc and a circulation path of the air will be first described, and after that, a mechanism by which the air blowing duct 330 is attached will be described.

The air blower 310 is intended for sucking the outside air and delivering the air into the air blowing duct 330. The air blowing duct 330 is constituted by a main duct 331 that guides the air in the depth direction of the apparatus and four branch ducts 335 that branch from the main duct 331. A lower portion (hereafter called a delivery portion 336) of each of the branch ducts 335 is bent toward the drum unit side, and the delivery portion 336 delivers the air supplied by the air blower 310 from the leading end thereof toward the unit frame 26.

The delivery portion 336 of the branch duct 335 faces the intake port 301 of the unit frame 26, and the air delivered from the delivery portion 336 flows through the intake port 301 and reaches each of the charging devices 30 within the drum unit Sa and each of the photosensitive drums 29.

The exhaust unit 370 is provided behind the drum housing space 7 within the main body casing 2.

The exhaust unit 370 is provided with a casing at the front of which three exhaust/suction ports 373 are provided in the width direction of the apparatus, and a blower 371 for exhaust is housed in the interior. Each of the exhaust/suction ports 373 is present in positions a little higher than the upper portion of the development cartridge 27.

Because of this, as indicated by alternate long and short dash lines in FIG. 20, the air fed to the interior of the drum unit Sa through the intake port 301 flows along the rear surface of the development cartridges 27 upward while being fed along the width direction of the drum unit Sa. And when the air has reached the upper part of the development cartridge 27, the air is sucked by the above-described exhaust unit 370 and exhausted to the outside. In this manner, the air around the charging device 30 is caused to circulate.

Figure 22:
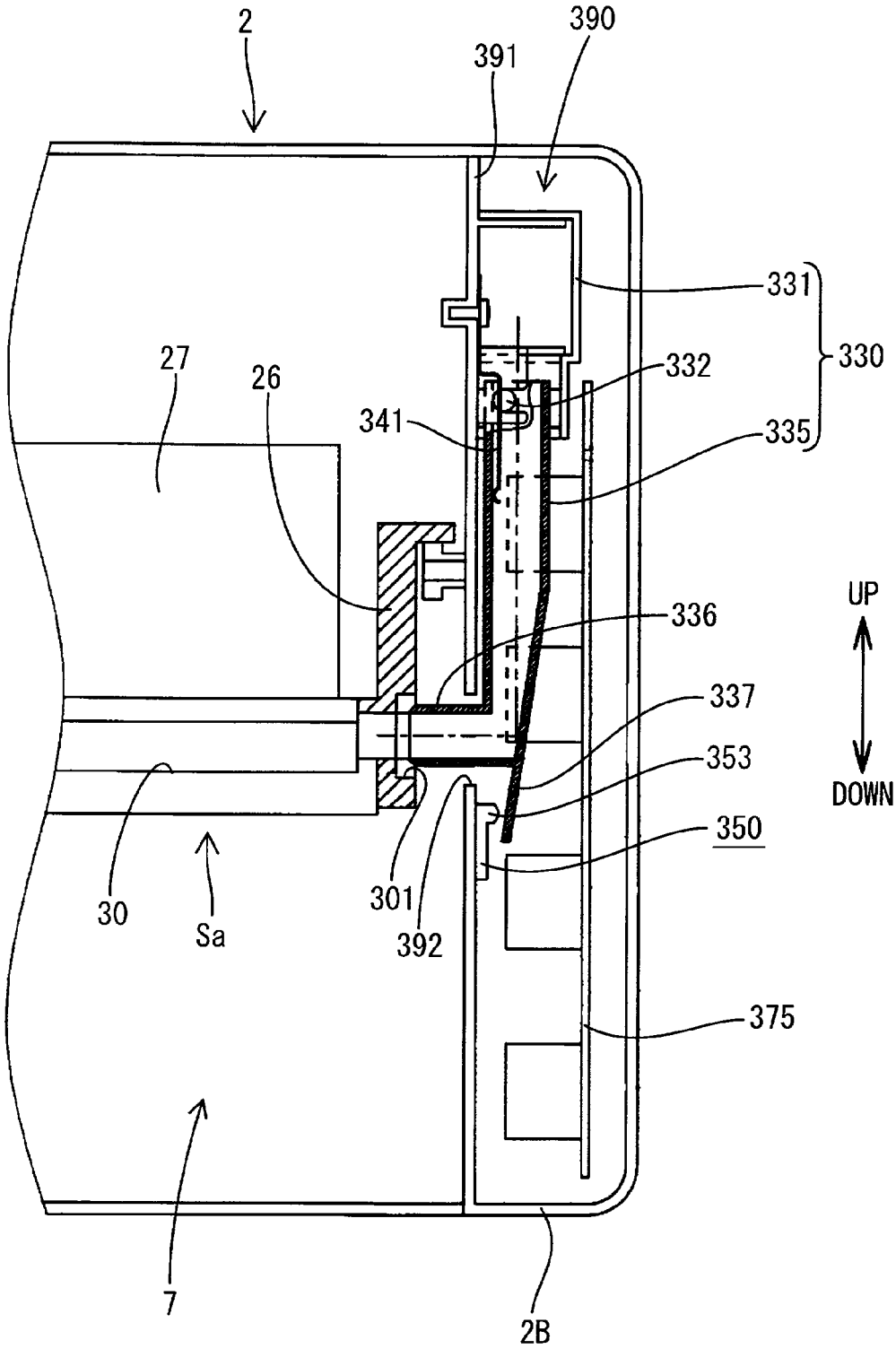
FIG. 22 is a diagram showing the insertion posture of a branch duct.

FIG. 22 shows a sectional view including a mechanism by which the air blowing duct 330 is attached. The interior of a right-hand wall 2B of the main body casing 2 is hollow, and this place provides a duct installation region 390. A duct insertion hole 392 opens in the lower portion of an inner wall 391 of the duct installation region 390. In the duct installation region 390, the above-described air blowing duct 330 is installed close to the inner wall 391.

The delivery portion 336 of the air blowing duct 330 enters the drum housing space 7 within the main body casing 2 through the duct insertion hole 392 and that, the leading end of the delivery portion 336 is inserted into the intake port 301 of the unit frame 26. Because the leading end of the delivery portion 336 is inserted into the intake port 301 like this, it is possible to efficiently feed the air in the duct into the unit frame 26. The posture of the branch duct 335 shown in FIG. 22, that is, the posture taken when the delivery portion 336 is inserted into the drum housing space 7, whereby the air in the duct can be blown into the unit frame 26, is called an insertion posture.

On the other hand, if the branch duct 335 is in an insertion position as described above, the delivery portion 336 interferes and provides an obstacle when the drum unit Sa is taken out of the drum housing space 7. For this reason, in this illustrative aspect, the branch duct 335 is given a variable construction so that the delivery portion 336 can be retracted from the drum housing space 7.

A mechanism by which the branch duct 335 is retracted will be described below.

First, as shown in FIG. 22, the main duct 331 that constitutes the air blowing duct 330 along with the branch duct 335 is fixed to an upper portion of the inner wall of the duct installation region 39. A hinge 332 is provided in the interior of the main duct 331.

An upper portion of the branch duct 335 is supported by the hinge 332, permitting an oscillating motion around the hinge 332 serving as the center. The reference numeral 341 shown in FIG. 22 denotes a plate spring. The plate spring 341 has the function of biasing the branch duct 335 to the inner side of the apparatus (the left-hand side in the figure).

An outer edge of a lower portion of this branch duct 335 is extended downward and this portion provides a disengaging operation piece 337. On the other hand, on the side wall of the duct installation region 390 is provided the second synchronous slider 350 at a level corresponding to the disengaging operation piece 337.

As shown in FIG. 20, the second synchronous slider 350 has a shape elongated in the depth direction of the apparatus and is provided with inclined surface portions 351 in the longitudinal direction and a wire fixing protrusion 359 at the leading end of the second synchronous slider 350.

Figure 21:
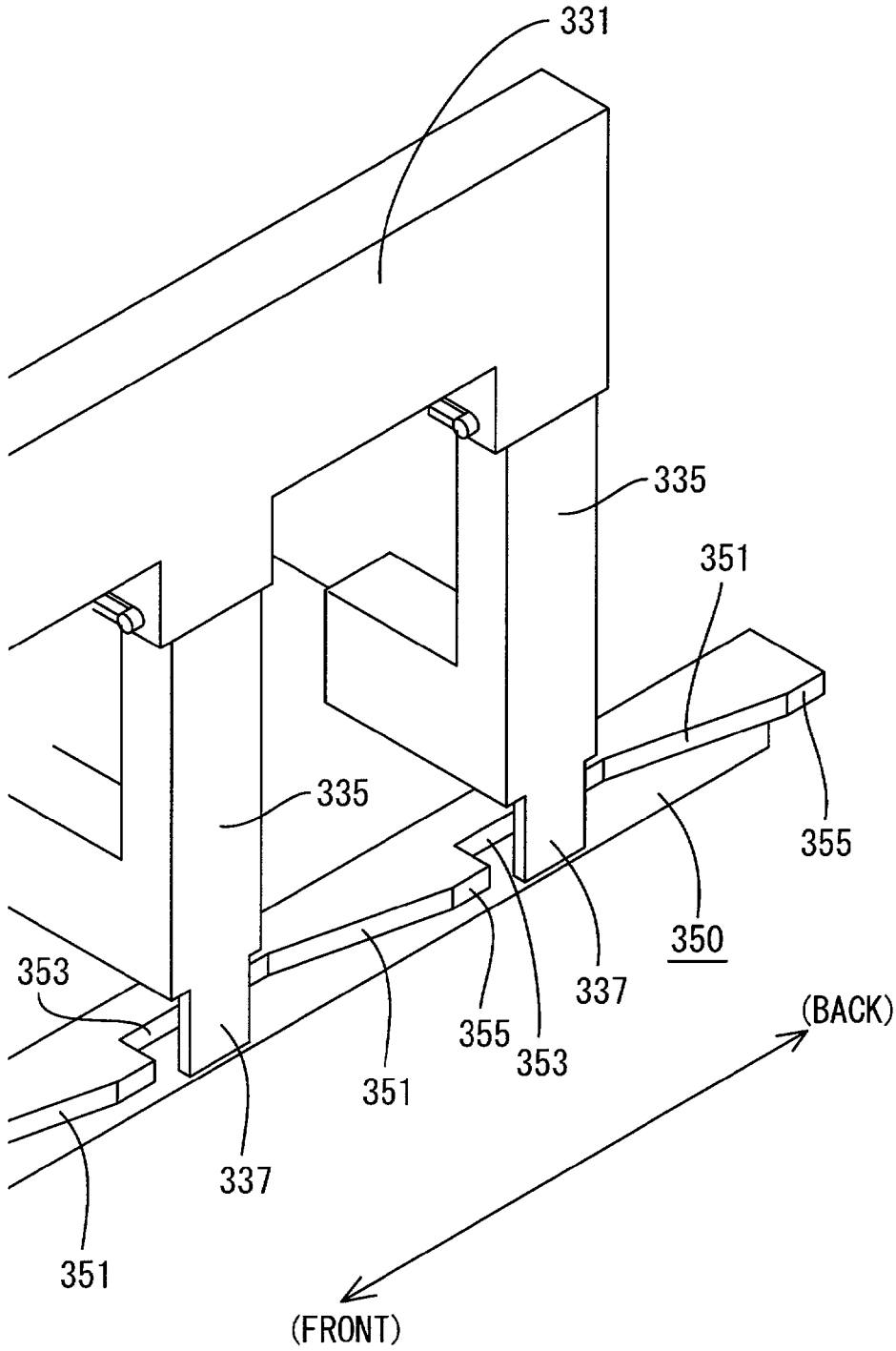
FIG. 21 is an enlarged diagram of an inclined plane portion.

As shown in FIG. 21, each of the inclined surface portions 351 has such a shape that the deeper toward the depth side of the apparatus, the larger the amount of an overhang to the outside. Flat portions 353, 355 are positioned in front and behind each of the inclined surface portions 351. The installation intervals of the inclined surface portions 351 can be set equal to the installation intervals of the disengaging operation pieces 337 of the branch duct 335 so that each of the inclined surface portions 351 forms a pair with each of the disengaging operation pieces 337.

The second synchronous slider 350 moves forward and backward horizontally along the depth direction of the apparatus, and the branch duct 335 resulting in a retracing action with the aid of the forward and backward motions of this slider 350.

Figure 24:
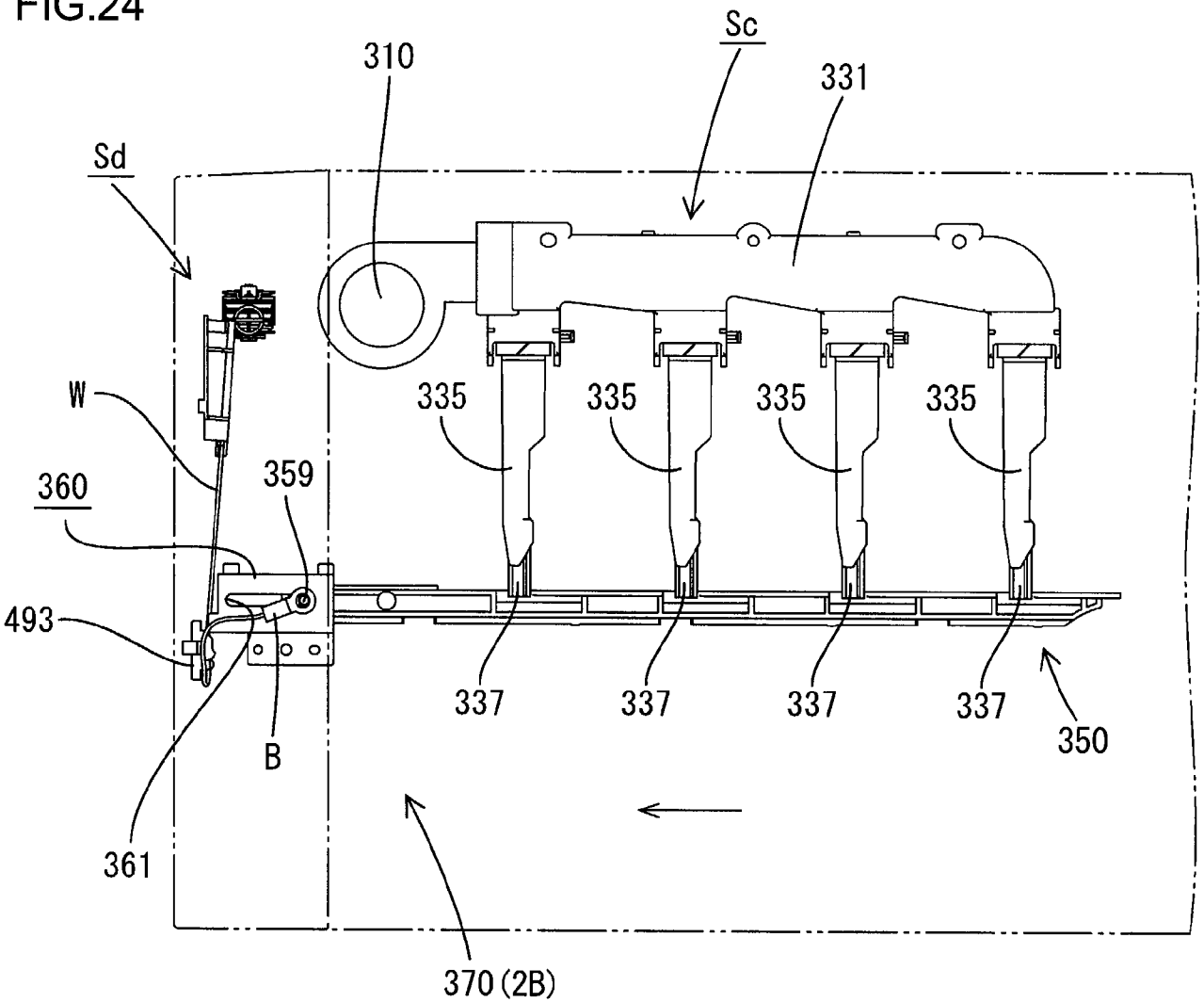
FIG. 24 is a diagram showing the initial position of a second synchronous slider.

To be more specific, as shown in FIG. 24, in the lower portion of the front end of the duct installation region 390, there is provided a front portion holder 360, which covers the front portion of the second synchronous slider 350. A guide hole 361 is formed on an outer surface of this front portion holder 360. A protrusion 359 is inserted into this guide hole 361. And an end B of a wire W is fixed to the leading end of the protrusion 359 that has been drawn out to the outside the front portion holder 360 through the guide hole 361.

For this reason, when the opening operation of the front cover 9 has been performed, the second synchronous slider 350 is drawn by the wire W and moves from the initial position shown in FIG. 24 to the front side of the apparatus (the left side in FIG. 24). Then the inclined surface portion 351 of the second synchronous slider 350 outwardly pushes in the disengaging operation piece 337 of the branch duct 335 (see FIG. 21). Because of this, each of the branch ducts 335 rotates around the hinge 332 serving as the center while resisting the biasing force of the plate spring 341, with the result that the delivery portion 336 retracts from the drum housing space 7.

Figure 25:
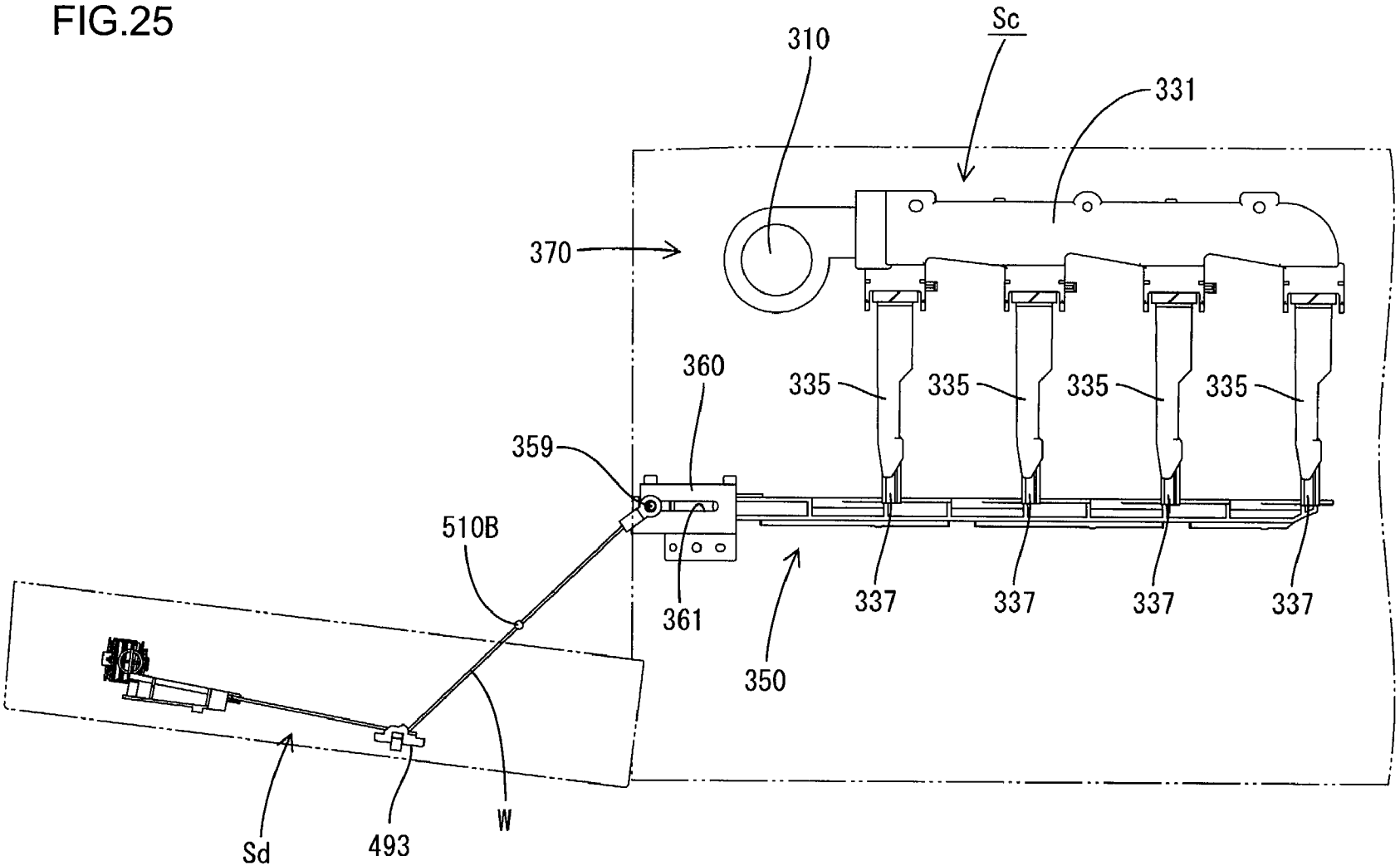
FIG. 25 is a diagram showing the stop position of a second synchronous slider.

When the second synchronous slider 350 has moved over a prescribed stroke and reached the stop position shown in FIG. 25, the protrusion 359 of the second synchronous slider 350 abuts against a wall of guide hole 361 and a further forward motion is restricted thereby. In this stop position, each of the disengaging operation piece 337 of the branch duct 335 has moved onto the flat portion 355 positioned behind the inclined surface portion 351, and the branch duct 335 is held in the retraction posture shown in FIG. 23. That is, the whole of the branch duct 335 including the delivery portion 336 is housed within the duct installation region 390 and comes to a condition retracted from the drum housing space 7.

When the second synchronous slider 350 is in the initial position shown in FIG. 24, each of the front-side flat portion 353 faces each of the disengaging operation piece 337 and it is ensured that the disengaging operation piece 337 is not pushed to outside the apparatus (see FIGS. 21 and 22).

In the foregoing, the description was given of the forward action of the second synchronous slider 350 from the initial position to the stop position. However, when the closing operation of the front cover 9 is performed, the second synchronous slider 350 performs a retracting action and returns to the initial position from the stop position. By this return action and by receiving the biasing force of the plate spring 341, the branch duct 335 displaces automatically from a retracting posture to an insertion posture.

The description of a mechanism by which the second synchronous slider 350 is caused to return is omitted. However, the front cover 9 is provided with a locking/depressing portion, and this locking/depressing portion pushes the second synchronous slider 350 to the back side of the apparatus when the closing operation of the front cover 9 is performed. The access action to the drum unit Sa performed by the air blowing device Sc is such that by displacing the branch duct 335 from a retracting posture to an insertion posture, it is ensured that the air in the duct can be blown into the unit frame 26.

(D) Opening Restricting Device

Next, the opening restricting device Sd will be described with reference to FIGS. 26 to 33.

Figure 26:
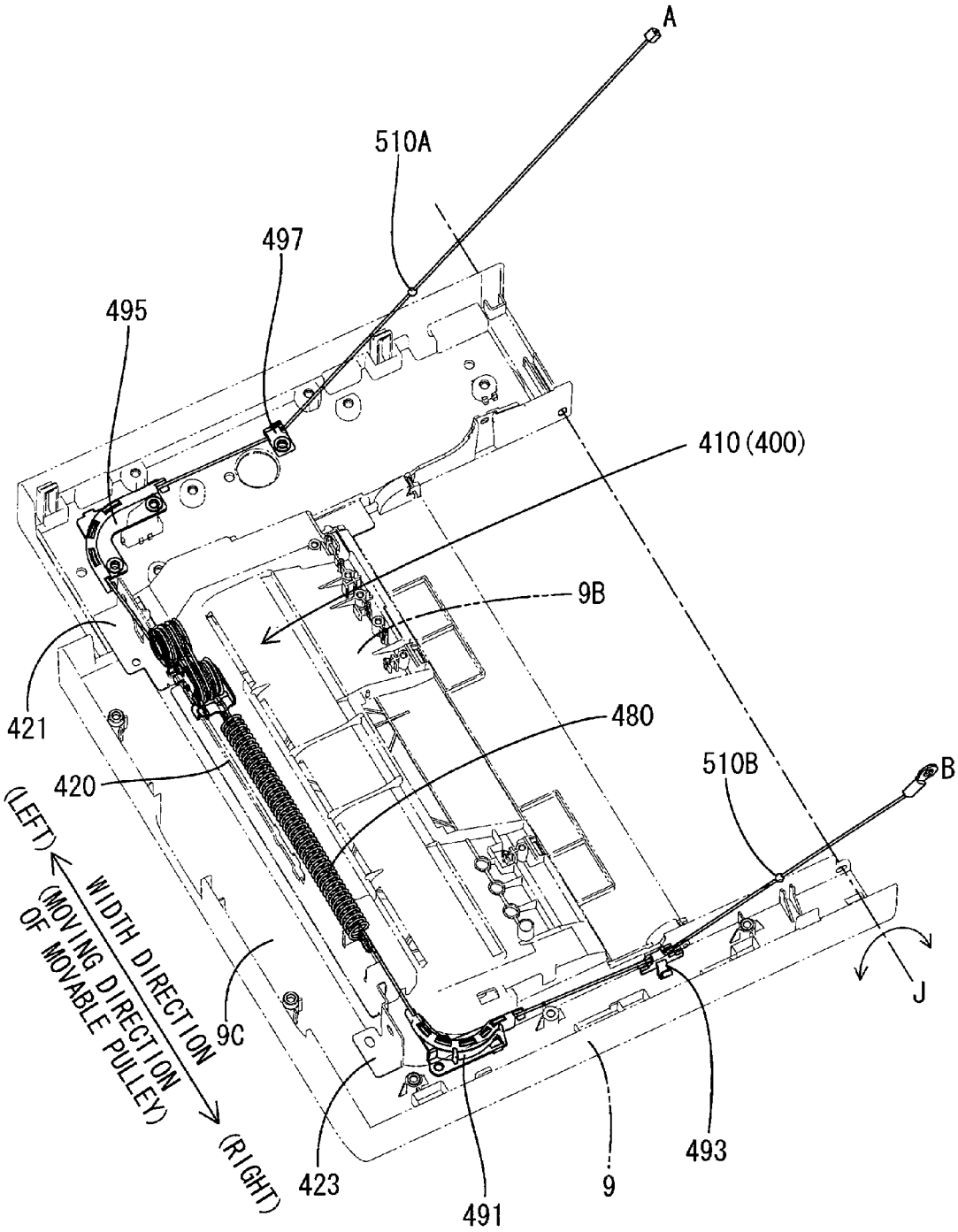
FIG. 26 is a perspective view of the general construction of an opening restricting device.
Figure 27:
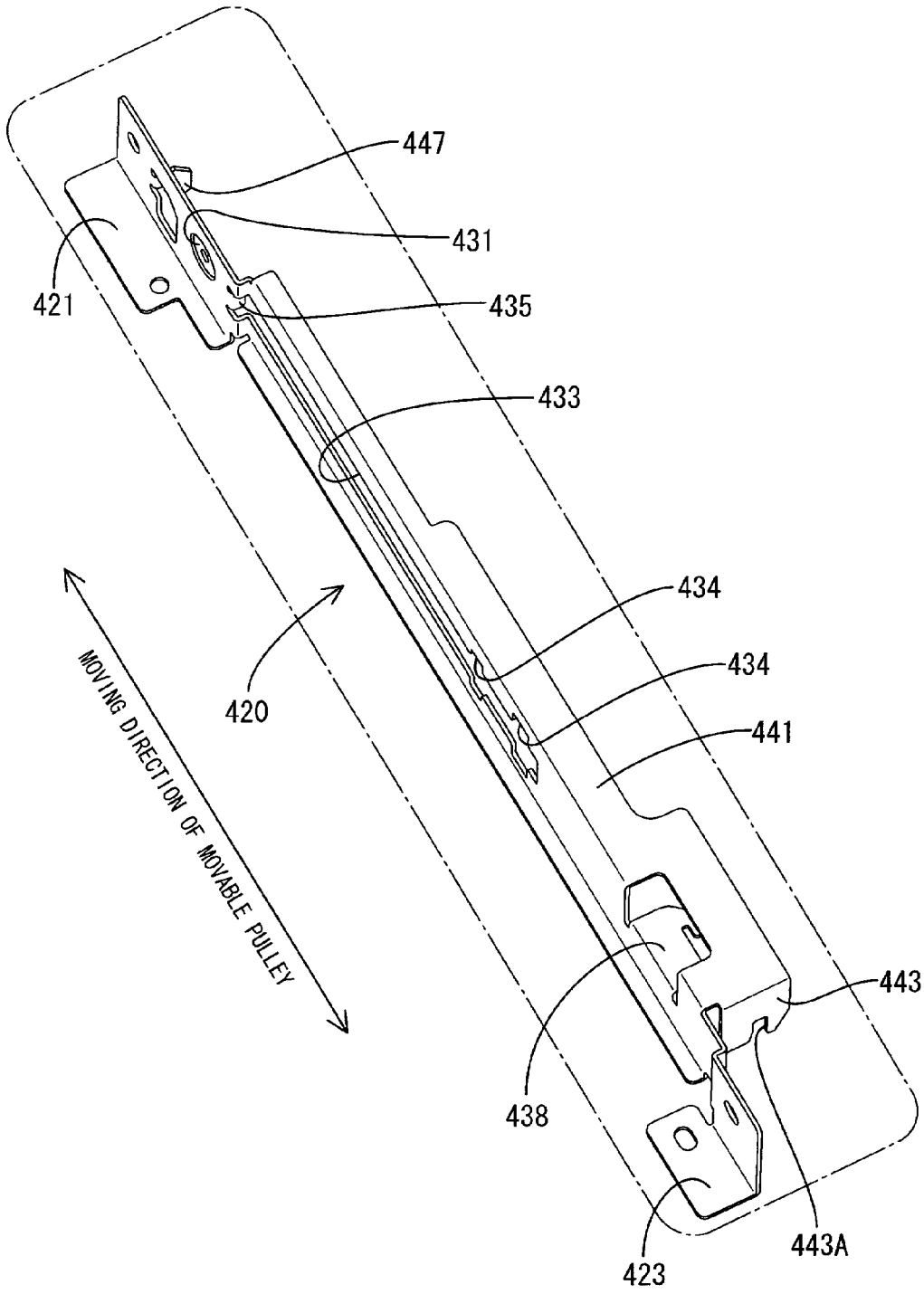
FIG. 27 is a perspective view showing the construction of a pulley holding plate.
Figure 28:
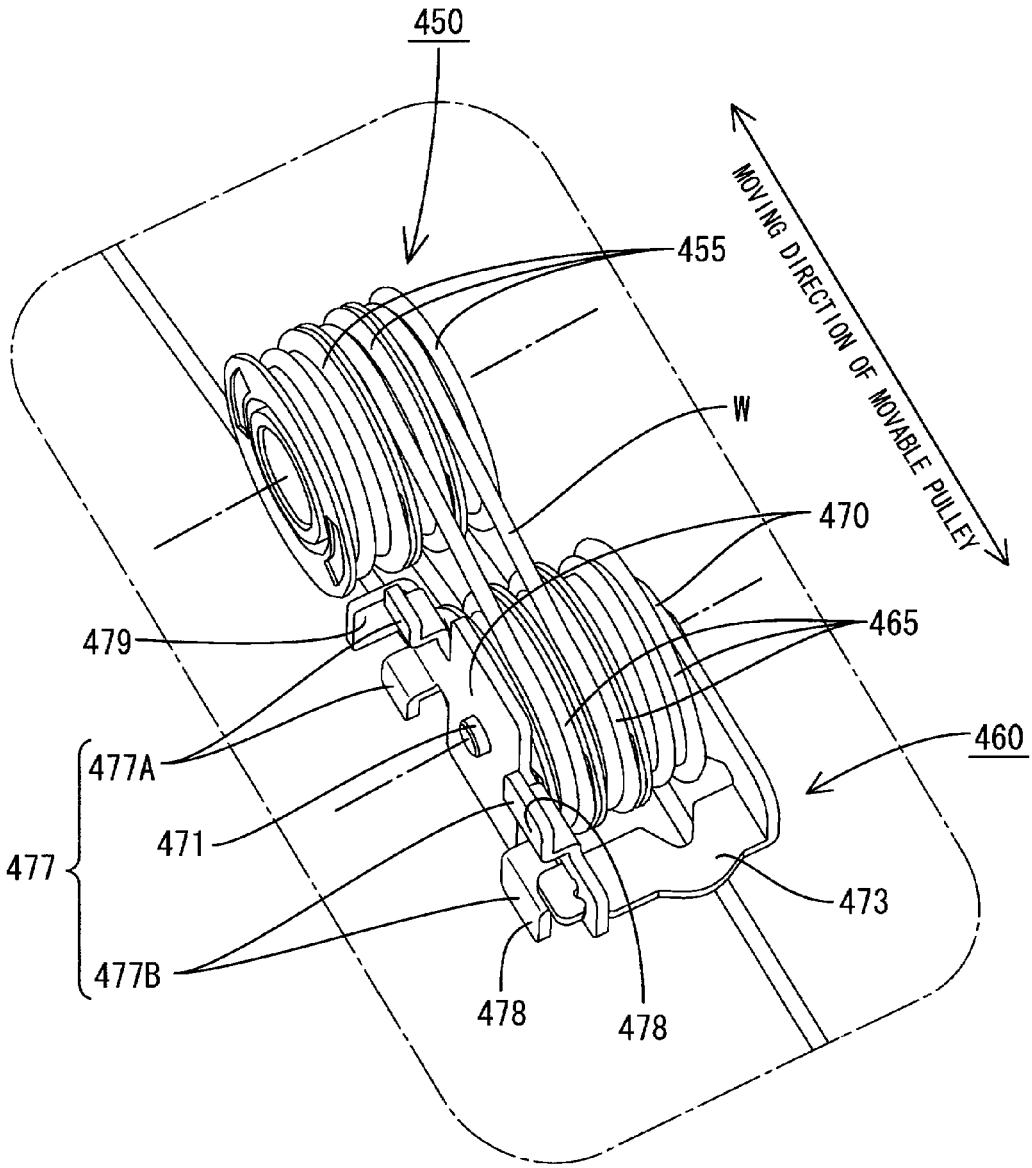
FIG. 28 is a perspective view of a pulley.

FIG. 26 is a perspective view showing the general construction of the opening restricting device. FIG. 27 is a perspective view showing the construction of a pulley holding plate. FIG. 28 is a perspective view of a pulley.

The opening restricting device Sd includes a wire take-up device 400 that uses a pulley block 410 is provided on a rear surface 9C of the front cover 9 and ends A and B of a wire W drawn out of both sides of the wire take-up device 400 are each fixed to each device incorporated on the main body casing 2 side. For example, the end A of the wire W is fixed to the front end of the first synchronous slider 271 constituting the depressing and spacing device Sb, and the end B of the wire W is fixed to the front end of the second synchronous slider 350 constituting the air blowing device Sc. The construction of each part will be described in detail below.

The pulley block 410 is constituted by a pulley holding plate 420, two pulleys 450, 460, and a wire W (e.g. a stainless steel strand wire). The pulley holding plate 420 is made of a metal and formed by press working a flat plate. As shown in FIG. 27, the pulley holding plate 420 has a shape elongated in one direction and is provided, on both sides thereof, with fixing portions 421, 423 for the front cover 9.

On the pulley holding plate 420 between the fixing portions 421, 423, there are provided a mounting seat portion 431, a guide groove 433 and a spring hooking portion 438 in this order from left in FIG. 27. The mounting seat portion 431 is formed by hammering out part of the plate surface, and the pulley 450 is installed there. The guide groove 433 extends straight in the longitudinal direction of the pulley holding plate 420. This guide groove 433 has the same groove width along the full length.

At the start end (the left-side end in FIG. 27) of the guide groove 433, there is provided a plate-side stopper portion 435 formed by bending part of the groove wall to the back side in the figure. Further, an insertion/extraction portion 434 is provided at the terminal end of the guide groove 433 (the right-side end in FIG. 27).

The spring hooking portion 438 is formed by bending part of the wall surface to the back side in the figure, and an end of the coil spring 480 is latched thereto. The coil spring 480 corresponds to an example of the biasing means of the present invention.

The reference numeral 441 shown in FIG. 27 denotes a reinforcing flange. This flange 441 is provided so as to overlap the installation area of the coil spring 480 with respect to the longitudinal direction of the pulley holding plate 420 (see FIG. 29) and acts so as to increase the rigidity of the pulley holding plate 420.

The reference numerals 443, 447 in FIG. 27 denote wire guide portions.

Subsequently, the pulleys 450, 460 mounted to the pulley holding plate 420 will be described with reference to FIG. 28. Although the pulley 450 is a fixed pulley that is installed in the mounting seat portion 431 in a fixed manner and the pulley 460 is a movable pulley that is slidably engaged with the guide groove 433, both have the same pulley shape (the shape of the body on which the wire W is wound). The body of the two pulleys 450, 460 can have a cylindrical shape and in a peripheral portion thereof, three wire grooves 455, 465.

The movable pulley 460 is rotatably supported to the pulley holder 470 by a rotary shaft 471. Included in the pulley holder 470 of the movable pulley 460 are the rotary shaft 471, a spring hooking portion 473, an engaging portion 477, a pulley-side stopper piece (corresponding to "part of the pulley holder" of the present invention) 479 and the like. The rotary shaft 471 serves as the central axis of rotation of the pulley body.

The spring hooking portion 473 forms a pair with the above-described spring hooking portion 438 of the pulley holding plate 420 and the other end of the coil spring 480 is latched thereto.

The pulley-side stopper piece 479 forms a pair with the plate-side stopper portion 435 provided in the pulley holding plate 420. The "stopper device" of the present invention is realized by the pulley-side stopper piece 479 and the plate-side stopper portion 435.

The engaging portion 477 of the pulley holder 470 is engaged with the guide groove 433 with a small clearance and has the function of guiding the forward and backward motions of the movable pulley 460 along the guide groove 433. In this illustrative aspect, a pair of the engaging portions 477 is provided in front of and behind the movable pulley 460 (front-side engaging portion 477A, rear-side engaging portion 477B). By forming the engaging portions 477A, 477B in front of and behind the movable pulley 460 like this, it becomes possible to stabilize the moving motion of the movable pulley 460 along the guide groove 433. Each leading end of the engaging portion 477 is outwardly bent and provides a holding portion 478 to latch the movable pulley 460 with respect to the guide groove 433.

As described earlier, the insertion/extraction portion 434 is provided at the terminal end of the guide groove 433, and by engaging the above-described engaging portion 477 with the insertion/extraction portion 434, it is possible to incorporate the movable pulley 460 in the guide groove 433.

Figure 29:
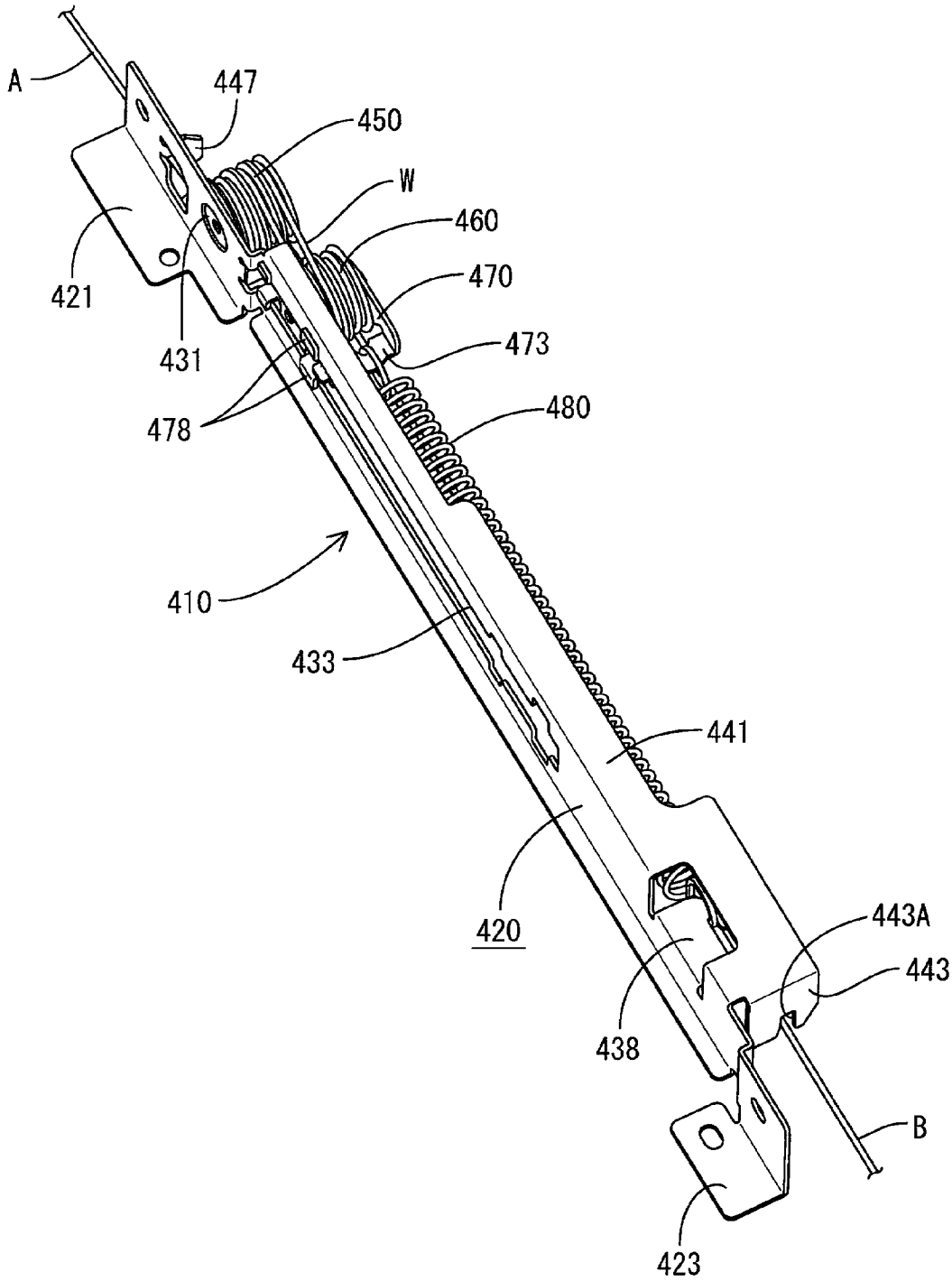
FIG. 29 is a perspective view that shows a condition in which a pulley and the like are attached to a pulley plate.

FIG. 29 shows a condition in which each part is attached to the pulley holding plate 420. That is, the fixed pulley 450 is connected to the mounting seat portion 431 of the pulley holding plate 420 (the rotation of the fixed pulley 450 is possible), and the movable pulley 460 is slidably installed in the guide groove 433.

The wire W is wound so as to be hung across the two pulleys 450, 460 along the wire grooves 455, 465 of the pulley body. The two ends A, B of the wire W are not fixed to the wire take-up device 400, and both of the two ends A, B are free ends capable of being drawn out. In other words, one end A of the wire W is drawn out to the left front side via wire guide portion 447 in FIG. 29, and the other end B of the wire W is drawn out to the right back side in FIG. 29 via a slit 443A provided at the leading end of a wire guide portion 443.

The coil spring 480 is hung across the pulley holding plate 420 and the movable pulley 460. The coil spring 480 performs the function of biasing the movable pulley 460 to the terminal end side of the guide groove 433, i.e., in the direction in which the movable pulley 460 is spaced from the fixed pulley 450.

As shown in FIG. 26, the wire take-up device 400 constructed as described above is installed in a condition in which the longitudinal direction is directed toward the width direction of the apparatus at the leading end of the rear surface 9C of the front cover 9.

A pair of wire supporting jigs 495, 497 is provided in the left-hand portion of the rear surface 9C of the front cover. One wire supporting jig 495 is installed at the corner of the leading end of the front cover and has an arc shape. The other wire supporting jig 497 is provided in an intermediate position between the arc-shaped wire supporting jig 495 and the hinge shaft J.

As a result of this, the end A of the wire W drawn out of the left side of the wire take-up device 400 turns around through approximately 90 degrees at the corner of the rear surface 9C of the front cover, thereafter takes a path toward the hinge shaft J and is eventually drawn out of the wire supporting jig 497 in the intermediate position. After taking this wire arrangement path, the leading end A of the wire W drawn out of the left side portion of the front cover 9 in the width direction is fixed to the front end of the first synchronous slider 271 provided on a left side wall 2A of the main body casing 2 (FIGS. 3 and 17).

On the other hand, a pair of wire supporting jigs 491, 493 is installed also at the right end of the rear surface 9C of the front cover. The wire supporting jig 491 is installed at the corner of the leading end of the front cover and has an arc shape. The other wire supporting jig 493 is provided in an intermediate position between the arc-shaped wire supporting jig 491 and the hinge shaft J.

As a result of this, end B of the wire W drawn out of the right side of the wire take-up device 400 turns around through approximately 90 degrees at the corner of the rear surface 9C of the front cover, and thereafter moves toward the hinge shaft J and is eventually drawn out of the wire supporting jig 493 in the intermediate position. After taking this wire arrangement path, the leading end B of the wire W (drawn out of the right side portion of the front cover 9 in the width direction) is fixed to the front end of the second synchronous slider 350 provided on a right side wall 2B of the main body casing (FIGS. 3 and 24).

As shown in FIGS. 3 and 26, spherical protrusions 510A, 510B are fixed to the wire W drawn out of the wire take-up device 400. The spherical protrusions 510A, 510B are provided as measures against malfunctions of the first synchronous slider 271 provided on the left side wall 2A of the main body casing 2 and the second synchronous slider 350 provided on the right side wall 2B of the main body casing 2. By way of example, the spherical protrusion 510A will be described in detail below.

As shown in FIG. 3, the spherical protrusion 510A is provided on the wire W in a fixed manner between the wire supporting jig 497 and the main body casing 2.

By adopting this construction, it is ensured that as the front cover 9 in an opening posture is closed, the spherical protrusion 510A moves as one piece as the wire W and becomes drawn to the front cover 9 side. As a result, when the front cover 9 has rotated to a certain degree in the closing direction, the spherical protrusion 510A abuts against an end surface of the wire supporting jig 497 (see FIGS. 30 and 31) and acts so as to resist the take-up of the wire W by the take-up device 400.

The above-described construction realizes that the draw-in restricting means is formed from a protrusion, or spherical protrusion 510A, 510B, that is fixedly provided on the string-like connection, or wire W, and the take-up of the string-like connection by the take-up device, or wire take-up device 400, is restricted when the protrusion that has been drawn in to the cover member, or front cover 9, side along with the string-like connection is caused to abut against other parts (497, 493) in the process of a closing operation of the cover member.

Because of this, the take-up by the wire take-up device 400 does not work before the spherical protrusion 510A and the leading end of the wire W, i.e., the portion of the wire W connected to the first synchronous slider 271 comes to a loose condition. That is, by providing the spherical protrusion 510A, the first synchronous slider 271 can be virtually disconnected from the wire take-up device 400.

If the above-described spherical protrusion 510A is not provided, there is nothing that restricts the take-up of the wire W by the wire take-up device 400. For this reason, even when the front cover 9 is in a closing posture, the take-up force of the wire take-up device 400 acts, with the result that the first synchronous slider 271 moves from an initial position in spite of the closing of the front cover 9 (i.e. malfunction).

For this reason, even when the front cover 9 in a closing posture is opened, it is impossible to perform a disengaging action due to the lack of the moving stroke of the first synchronous slider 271 for a scheduled moving stroke.

In this illustrative aspect, spherical protrusions 510A, 510B are provided on the wire W in order to prevent the occurrence of such troubles. Because of this, in the process of closing the front cover 9, it becomes possible to disconnect the first synchronous slider 271 and the second synchronous slider 350 from the wire take-up device 400. As a result, when the front cover 9 is in a closing position, a force toward the front of the apparatus does not act on the first synchronous slider 271 nor the second synchronous slider 350 and hence it is possible to hold the two sliders 271, 350 in the initial positions thereof.

3. Operation

Next, for the laser printer 1 constructed as described above, the operation of the present invention associated with the opening and closing operation of the front cover 9 will be described below in three stages.

(A) Opening Restriction of Front Cover

The front cover 9 rotates in the opening direction, with the hinge shaft J serving as the center, when a manipulation portion 9A provided in the upper portion of the front cover in a closing posture is drawn toward the operator by hand. As a result of this, the opposed distance between the front cover 9 and the main body casing 2 widens, whereby the wire W in a slack condition becomes extended and comes to a stretched condition.

When the front cover 9 is further operated in the opening direction from this condition, the first synchronous slider 271 and second synchronous slider 350 provided in the main body casing 2 are each drawn by the wire W to the front side of the apparatus. As a result, the first synchronous slider 271 moves from the initial position shown in FIG. 17 to the stop position and the second synchronous slider 350 moves from the initial position shown in FIG. 24 to the stop position.

Figure 32:
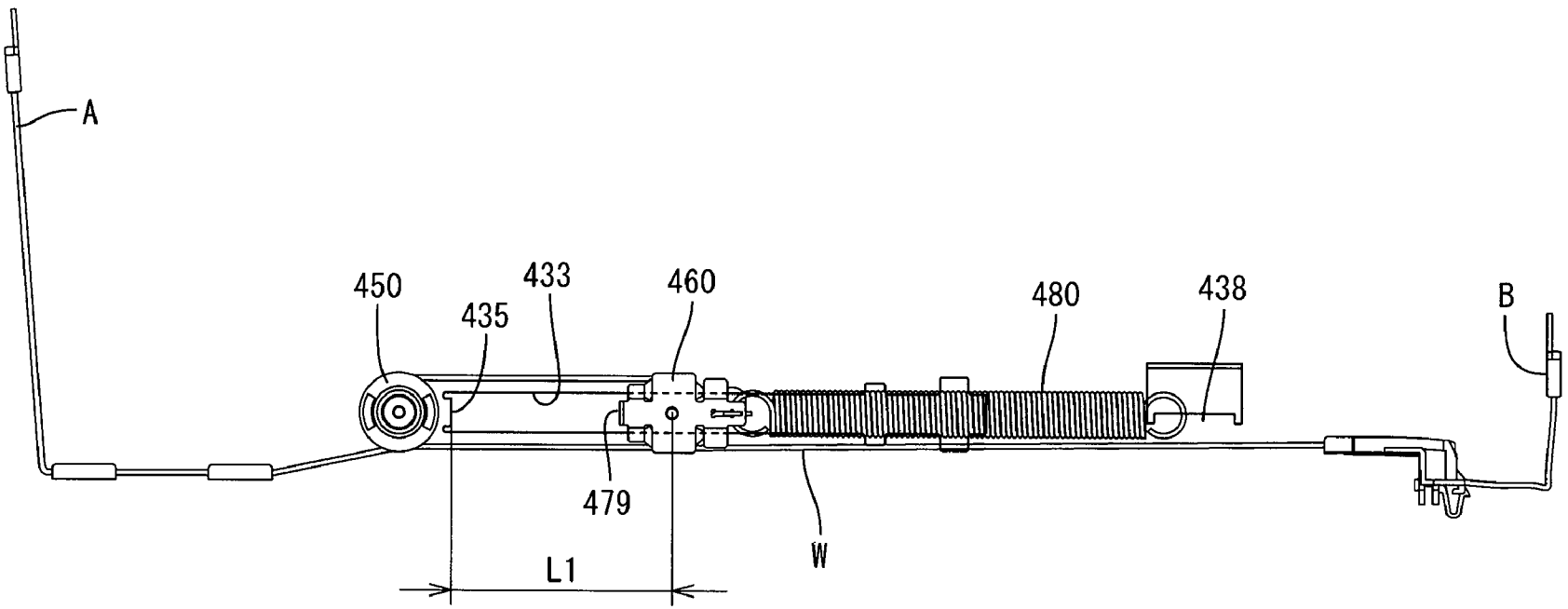
FIG. 32 is a diagram showing the positional relationship of two pulleys when the front cover is in a closing posture.
Figure 33:
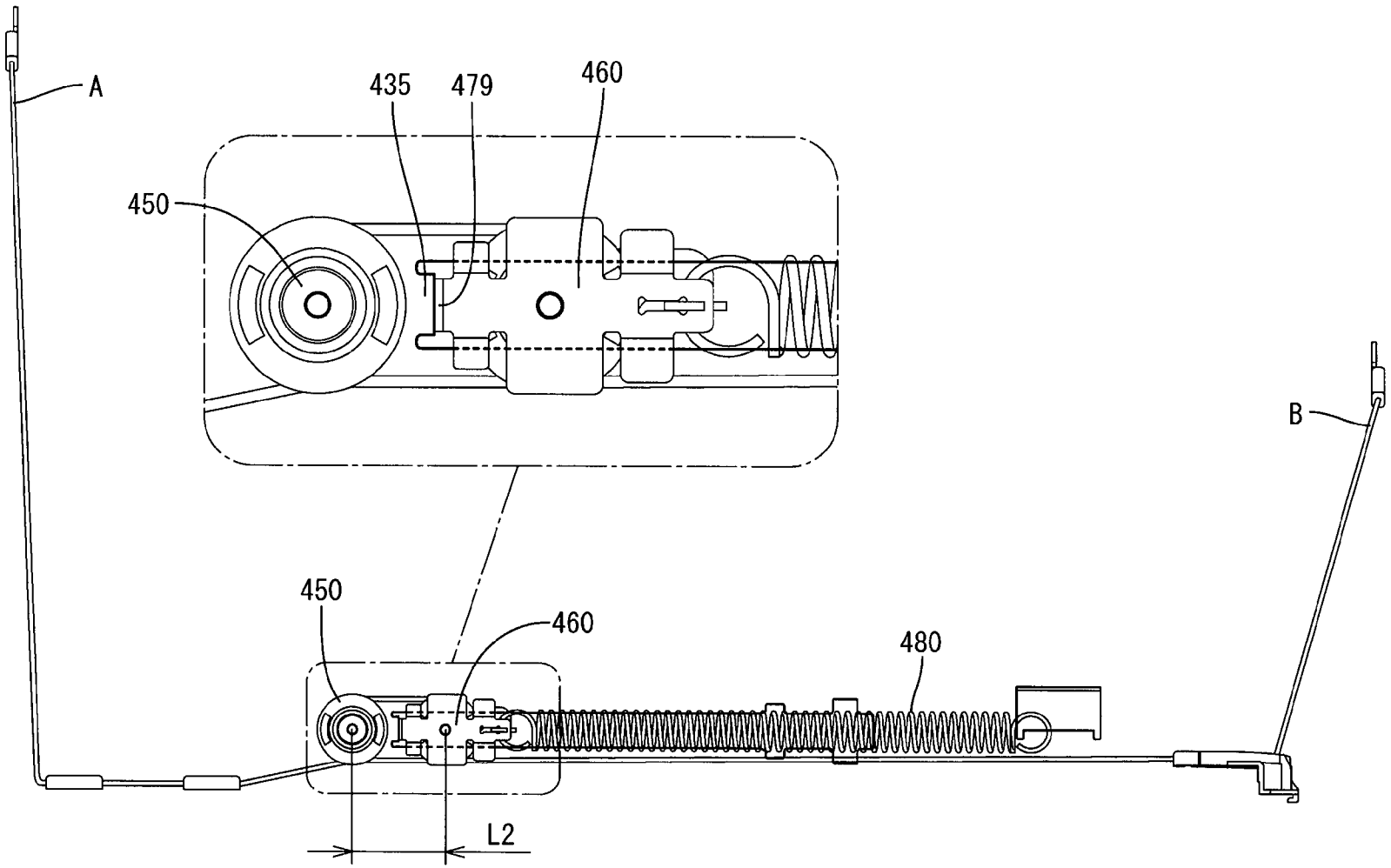
FIG. 33 is a diagram showing the positional relationship of two pulleys when the front cover is in an opening posture.

Before long the synchronous sliders 271, 350 reach their respective stop positions and a further forward motion is restricted. Then in the wire take-up device 400, the movable pulley 460 begins to move toward the fixed pulley 450 while causing the coil spring 480 to extend (FIGS. 32 and 33).

As a result of this, because the distance between the two pulleys 450, 160 decreases from the length L1 in the initial condition, the wire W is paid out of the wire take-up device 400. Before long, as shown in FIG. 33, where the pulley-to-pulley distance between the two pulleys 450, 160 has become L2, the pulley-side stopper piece 479 of the movable pulley 460 abuts against the plate-side stopper portion 435 provided in the pulley holding plate 420.

Because of this, the movement of the movable pulley 460 in the approaching direction is restricted, resulting in the paying out of the wire W is stopped. In this manner, the opening of the front cover 9 is restricted in the opening posture shown in FIG. 3.

That is, even when operation from the opening posture shown in FIG. 3 to the opening direction is to be performed, both of the two synchronous sliders 271, 350 of the main body casing 2 are already in their respective stop positions. Furthermore, the wire W comes to a stretched condition between the two synchronous sliders 271, 350 and the front cover 9. Therefore, the front cover 9 will not be opened in the opening direction beyond the opening posture.

This realizes that the first and second string-like connections, or wire W), along with the first and second displacement members, or first and second synchronous sliders 271, 350, in the stop position, constitute an opening restricting device and restrict the opening angle of the cover member, or front cover 9, to a prescribed angle.

In this illustrative aspect, the magnitude of the spring force of the coil spring 480 (the spring force at a maximum elongation of the condition shown in FIG. 33) is suppressed to an extent weaker than the total weight of the front cover 9. Because of this, in an opening condition, the weight of the front cover 9 surpasses the spring force of the coil spring 480 and the opening posture of the front cover 9 is maintained.

On the other hand, the front cover 9 in an opening posture is rotated in the closing direction by applying a force thereto, whereby the front cover 9 can be restored to the closing posture by manual operation. During this closing operation, contrary to the case of the opening operation, the biasing force of the coil spring 480 acts so as to promote the operation. For this reason, it is possible to close the front cover 9 with a force lighter than the operation force required when the wire take-up device 400 is not set.

Figure 30:
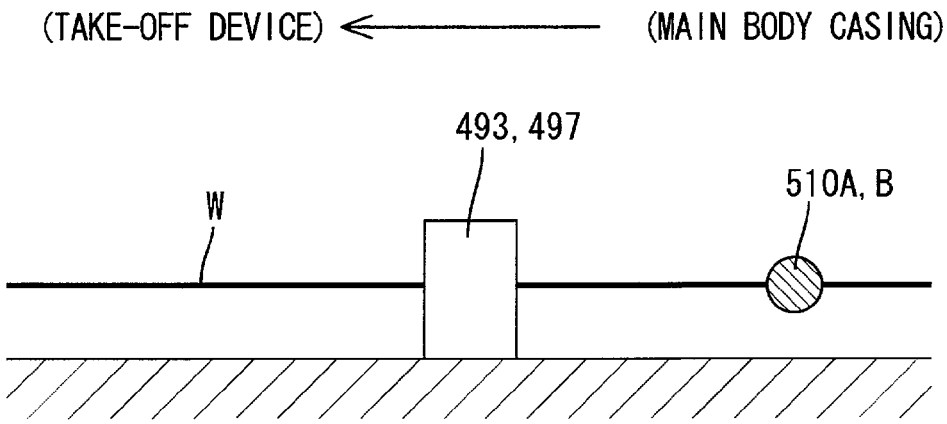
FIG. 30 is a diagram that shows how a spherical protrusion is take up to the take-up device side.
Figure 31:
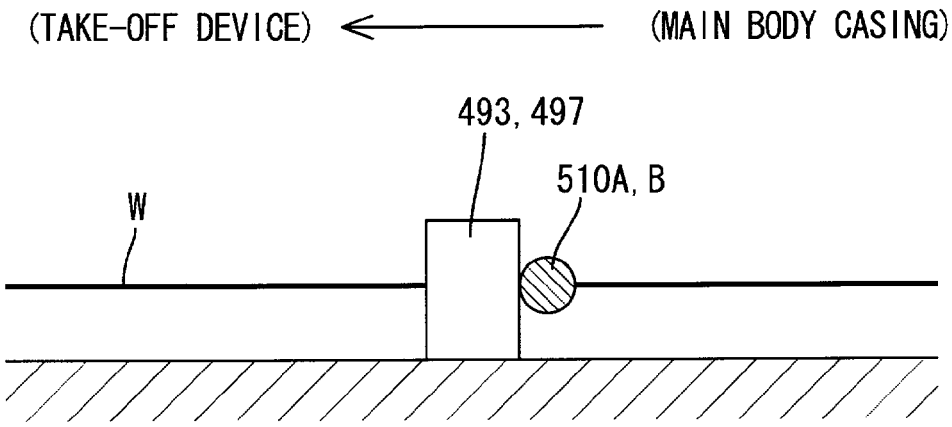
FIG. 31 is a diagram that shows how a spherical protrusion collides against a wire supporting jig and the draw-in of a wire is controlled.

Furthermore, because the opposed distance between the front cover 9 and the main body casing 2 narrows as the closing operation proceeds, the wire W hung across the two becomes slack, this slackness is all taken up by the wire take-up device 400. And when the take-up of the wire W has been performed, as shown in FIGS. 30 and 31, the spherical protrusions 510A, 510B of the wire W approach the corresponding wire supporting jigs 493, 497, and eventually abut against the wire supporting jigs 493, 497, where the draw-in of the wire W is restricted.

Figure 18:
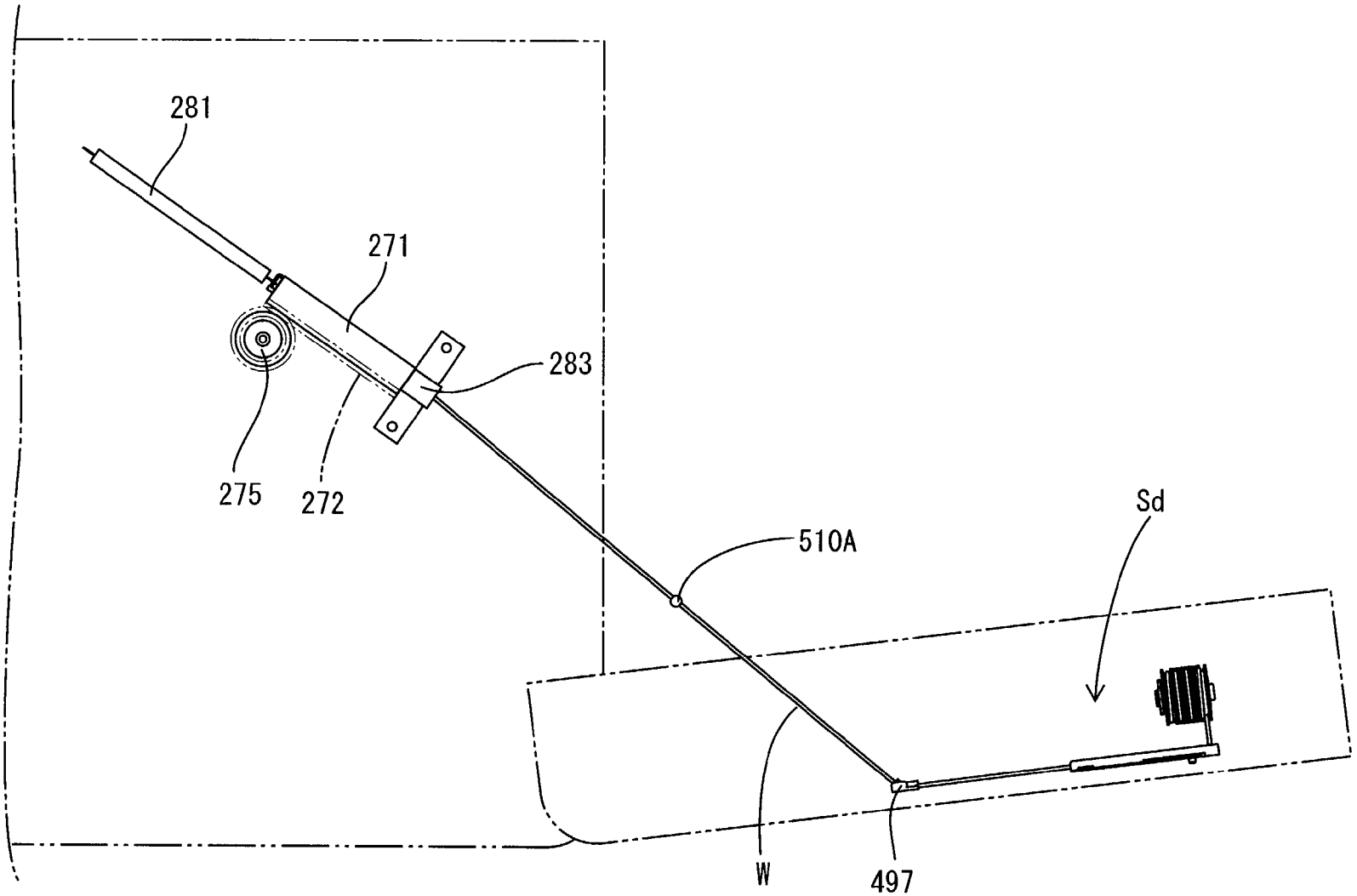
FIG. 18 is a diagram showing the stop position of a first synchronous slider.

Because of this, the first synchronous slider 271 becomes disconnected from the wire take-up device 400, the first synchronous slider 271 becomes drawn in by the coil spring 281 toward the back side of the apparatus, with the result that first synchronous slider 271 returns to the initial position shown in FIG. 17 from the stop position shown in FIG. 18. On the other hand, the second synchronous slider 350 is pushed by push-in means (not shown) toward the back side of the apparatus and returns from the stop position shown in FIG. 25 to the initial position shown in FIG. 24.

(B) Disengaging Action of Direct-Acting Cam Member 140 by Synchronous Slider 271

A description will be given here of an example in which the opening operation of the front cover 9, with the direct-acting cam member 140 is held in the depressing position shown in FIG. 11, for reasons such as the turning-off of the power during image formation.

As already described in connection with the opening restriction in (A) above, when the front cover 9 is opened from a closing posture, the first synchronous slider 271 moves from the initial position shown in FIG. 17 to the stop position. Then in the process of movement from this initial position to the stop position, the first synchronous slider 271 meshes with the pinion gear 275 and causes the pinion gear 275 to rotate.

When the pinion gear 275 rotates, the fixed gear 261 rotates in one piece with the pinion gear 275, with the result that the gearing 260 is actuated. That is, the fixed gear 261 rotates and causes the swivel arm 265 to swing, and the swivel arm 265 raises the swivel gear 263.

Then the raised swivel gear 263 meshes with the lower gear 165 of the power input plate 161. As a result, after that, part of the power associated with the opening of the front cover is transmitted via the route: wire W, first synchronous slider 271, pinion gear 275, fixed gear 261, swivel gear 263, power input plate 161.

Because of this, the direct-acting cam member 140 begins to move toward the disengaging direction. That is, in the original depressing position, the working portion for depression 145 that latches the depressing protrusion 125 (by filling the first communication hole 11) retreats to behind the apparatus.

Figure 16:
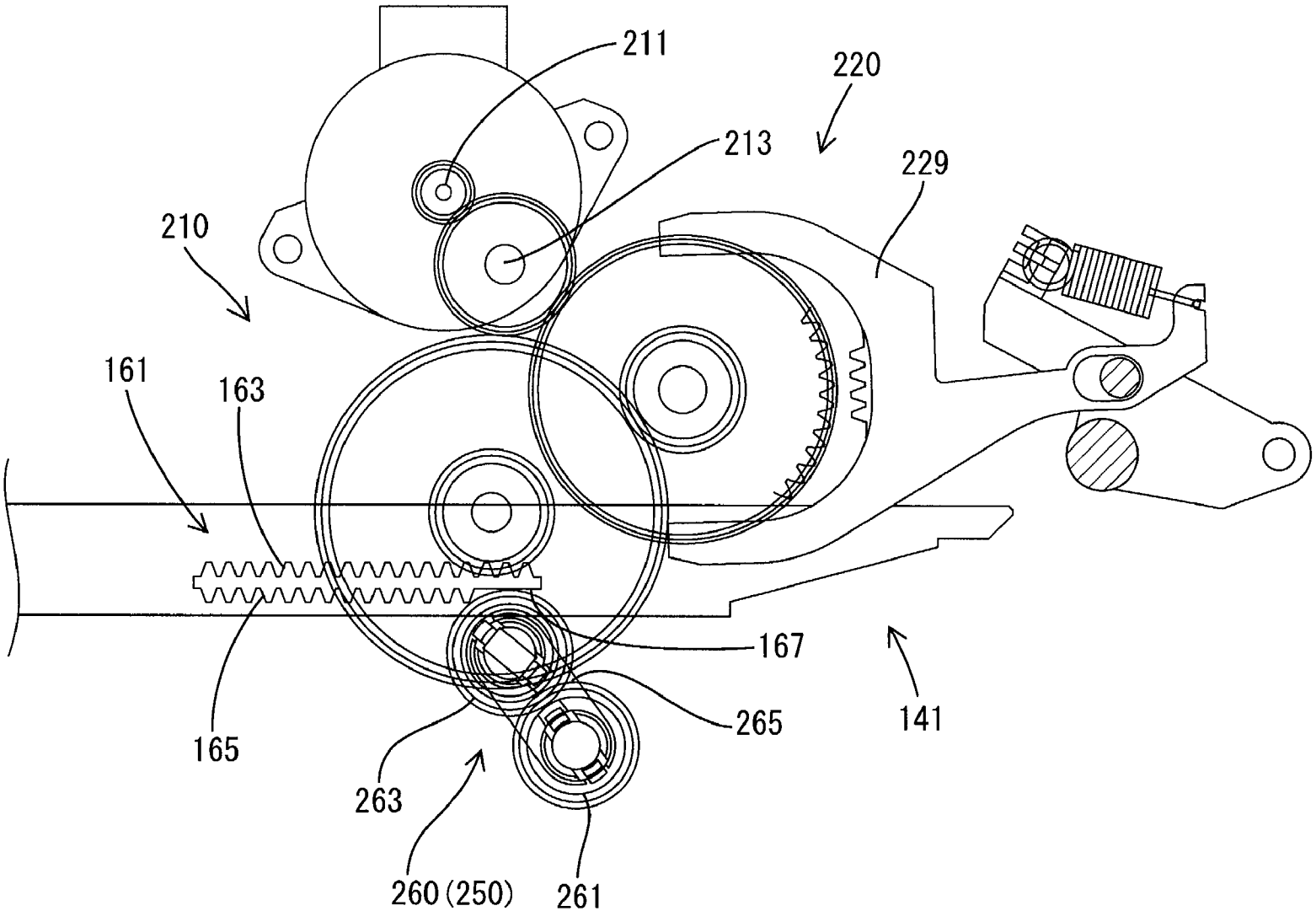
FIG. 16 is a diagram that shows how a planet gear is freewheeling due to a portion without a tooth.

Then, the direct-acting cam member 140 reaches the disengaging position (FIGS. 9 and 16). In this disengaging position, as shown in FIG. 9, each of the working portions for depressing 145 is behind each of the first communication holes 115 and opens the first communication hole 115. Because of this, the latching of the depressing protrusion 125 by the working portion for depression 145 is cancelled and it becomes possible to remove the drum unit Sa from the drum housing space 7 of the main body casing 2.

This realizes that the first displacement member, or first synchronous slider 271, displaces the movable member, or direct-acting cam member 140, in the depressing position to a disengaging position by a displacement action from the initial position to the stop position, thereby undoing the engagement by the working portion for depression, or canceling the latching of the depressing protrusion 125 by the working portion for depression 145.

(C) Retracting Action of Branch Duct 335 by Synchronous Slider 350

First, when the front cover 9 is in a closing posture, the branch duct 335 is in the insertion posture shown in FIG. 22, that is, the delivery portion 336 pierces through a duct insertion hole 392 and enters the drum housing space 7 within the main body casing 2, the leading end thereof inserted into the intake port 301 of the unit frame 26.

When the front cover 9 is opened from this condition, as already described in connection with the opening restriction in (A) above, the second synchronous slider 350 is drawn from the initial position shown in FIG. 24 to in front of the apparatus. Then the inclined surface portion 351 of the second synchronous slider 350 outwardly pushes out the disengaging operation piece 337 of the branch duct 335 from the initial position shown in FIG. 24 (see FIG. 21). Because of this, each of the branch ducts 335 rotates around the hinge 332 while resisting the biasing force of the plate spring 341, with the result that the delivery portion 336 retracts from the drum housing space 7.

This realizes that the second displacement member, or second synchronous slider 350, displaces the air blowing duct, or branch duct 335, from the insertion posture to the retraction posture by a displacement action from the initial position to the stop position.

Figure 23:
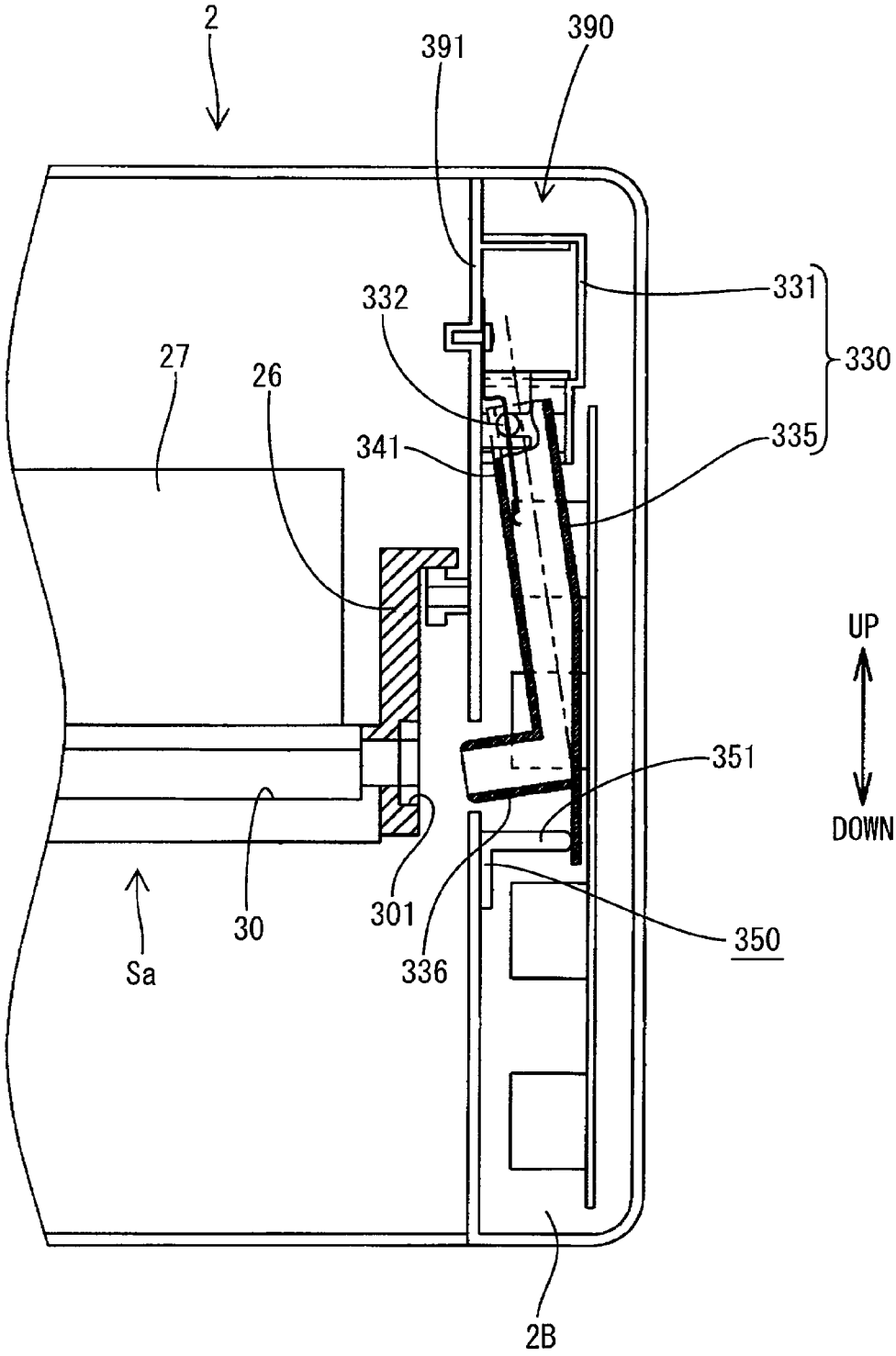
FIG. 23 is a diagram showing the retraction posture of a branch duct.

Although the second synchronous slider 350 reaches the stop position shown in FIG. 25, in this stop position each of the disengaging operation pieces 337 of the branch duct 335 has moved onto the back-side flat portion 355 of the second synchronous slider 350 and the branch duct 335 is held in the retraction posture shown in FIG. 23.

That is, the whole of the branch duct 335 including the delivery portion 336 is housed within the duct installation region 390 and comes to a condition in which the whole of the branch duct 335 retracts from the drum housing space 7. Therefore, when the drum unit Sa is removed from the drum housing space 7 of the main body casing 2, the delivery portion 336 will not interfere nor provide an obstacle to taking out the drum unit Sa.

In this illustrative aspect, the first synchronous slider 271 is provided on the left side wall 2A of the main body casing 2 so as to correspond to the direct-acting cam member 140, the second synchronous slider 350 is provided on the right side wall 2B of the main body casing 2 so as to correspond to the branch duct 335, and the two synchronous sliders 271, 350 and the front cover 9 are connected by the wire W.

Because of this, when the opening operation of the front cover 9 in a closing posture is performed, the two sliders 271, 350 perform retraction motions by being drawn by the wire W, the direct-acting cam member 140 is automatically displaced from the depressing position to the initial position and the branch duct 335 is automatically displaced from an insertion posture to a retraction posture. As a result of this, the constraining of the drum unit Sa by the direct-acting cam member 140 and the branch duct 335 is cancelled and, therefore, the drum unit Sa can be easily taken out of the drum housing space 7.

In addition, in this illustrative aspect, the first and second synchronous sliders 271, 350 and the wire have the function of restricting the opening of the front cover 9. In this manner, the synchronization mechanism that actuates other devices Sb, Sc in synchronization with the opening operation of the front cover 9 also has the opening restricting function and, therefore, the mechanism of the apparatus can be simplified.

Also, in this illustrative aspect, the first synchronous slider 271 and the second synchronous slider 350 are arranged separately on both side walls 2A, 2B of the main body casing 2. If both of the first and second sliders 271, 350 are provided on the side wall on one side of the main body casing 2, then on the installed side the resistance increases due to friction among parts and the opening and closing operations become heavy, with the result that it becomes impossible to keep the balance with the noninstalled side. However, by arranging the two sliders 271, 350 on the right and left side walls 2A, 2B of the main body casing 2 as in this illustrative aspect, the right and left balance is ensured and it becomes possible to smoothly perform the opening and closing operations of the front cover 9.

In this illustrative aspect, the wire W is used to synchronize the front cover 9 and the main body casing 2 side with each other. The use of the wire W is advantageous in terms of space compared to the use of rigid-body parts such as a link, and contributes to the miniaturization of the apparatus.

In this illustrative aspect, the front cover 9 is provided with the wire take-up device 400 so that an take-up force acts on the wire W. With this construction, a force of an appropriate magnitude is applied via the wire W to the front cover 9 in the closing direction. Therefore, because during the opening operation, this force in the closing direction acts in such a manner as to suppress impetus, the front cover 9 will not be opened with impetus.

Because the wire take-up device 400 is usually provided on the rear surface 9C of the front cover 9 that often provides a dead space, this is advantageous also for minimizing the apparatus.

In this illustrative aspect, the movable pulley 460 is used in paying out and drawing in the wire W. With the movable pulley 460, the wire W is smoothly paid out and drawn. Furthermore, it is possible to reduce the moving stroke of the movable pulley itself with respect to the draw-in amount of the wire W. Therefore, it is possible to miniaturize the wire take-up device 400.

In this illustrative aspect, the draw-in of the wire W is restricted (the stopper device) by using the pulley holder 470. With this construction, it is unnecessary to provide a dedicated parts for the stopper device and it is possible to reduce the number of parts. Also, in this illustrative aspect, the draw-in restriction of the wire W is performed by prohibiting the relative movement between the pulleys 450 and 460. Therefore, as a matter of course, it is possible to simultaneously perform measures against the interference with the pulleys each other.

The wire W can be made of stainless steel. Because the material is stainless steel, it is possible to provide an opening restricting mechanism having high strength and high reliability. Furthermore, because the wire W made of stainless steel has electrical conductivity, it is possible to cause the front cover 9 to conduct through the main body casing 2 through the wire W. Therefore, the use of the wire W is made of stainless steel is effective also as measures against electrostatic nuisances and hazards (it is possible to cause the static electricity of the front cover 9 to escape to the main body casing 2).

In this illustrative aspect, both the first synchronous slider 271 and the second synchronous slider 350 perform a sliding action toward the opening of the main body casing as a displacement action. Because the function performed by the first and second synchronous sliders 271, 350 is to displace the direct-acting cam member 140 from a depressing position to a disengaging position and to displace the branch duct 335 from an insertion posture to a retraction posture, it is necessary only that the power for causing the direct-acting cam member 140 and the branch duct 335 to perform a displacement action be capable of transmitted by some form.

From this point of view, the first synchronous slider 271 and the second synchronous slider 350 may perform different motions (for example, rotation for one and slide for the other). However, in this illustrative aspect, a slide action is specified for both. If the motion differs, the balance becomes bad and "prying" occurs. Therefore, it is feared that the opening and closing of the front cover 9 or actions of the sliders 271, 350 as displacement members may be interfered with. However, such troubles can be prevented by specifying a slide action for both as in this illustrative aspect.

The description of this illustrative aspect was as follow. That is when the opening operation of the front cover 9 in a closing posture is performed, first, the wire W in a slack condition comes to a stretched condition and thereafter the first and second synchronous sliders 271, 350 move from an initial position to a stop position. And after the movement, the wire take-up device 400 pays out the wire W.

However, the order of these motions is diverse depending on setting. For example, in parallel with the movement action in which the sliders 271, 350 move from the initial position to the stop position, the wire take-up device 400 may pay out the wire W. Furthermore, the construction may also be such that the sliders 271, 350 move from the initial position toward the stop position after the wire take-up device pays out the wire W.

<Other Illustrative Aspects>

The present invention is not limited to the illustrative aspect described by the above descriptions and drawings and, for example, the following illustrative aspects are included in the technical scope of the present invention.

(1) Although in this illustrative aspect, the front cover 9 was illustrated as an example, others may be allowed so long as they are covers used in an image forming apparatus (not limited to a laser printer so long as it forms an image on a recording medium). For example, a rear cover provided on the rear surface of the main body may be applied.

(2) Although in this illustrative aspect, a pulley block constituted by a movable pulley and a fixed pulley was used as the wire take-up device, any device can be applied so long as it can take up a wire. For example, it is possible to use a device that takes up a wire by the rotation of a winding shaft.

(3) Although in this illustrative aspect, the depressing and spacing device Sb and the air blowing device Sc were shown as the device that is actuated in synchronization with the opening action of the front cover 9, other devices may be synchronized.

For example, in the driving mechanism for the rotational driving of the photosensitive drum 29 or the developing roller 39 (including the supply roller and the like), it is possible to use a mechanism structured so the connection between the photosensitive drum 29 or the developing roller 39 and the driving source (a motor and the like) is maintained when the front cover 9 is in a closed condition, whereby the driving mechanism is kept in a condition capable of performing an image forming action, and during the opening action of the front cover 9, the photosensitive drum 29 or the developing roller 39 is disconnected from the drive so that the removal (draw-out) operation of the drum unit Sa is not interfered with.

What is claimed is:

1. An image forming apparatus, comprising:

a main body casing;

a cover member that is connected to an opening provided in the main body casing via a hinge shaft and closes or opens the opening;

a first device that is positioned within the main body casing and has a first function;

a first displacement member that is positioned in the main body casing and is configured to displace between an initial position and a stop position which causes the first device to perform a first action;

a first string-like connection that is connected between the first displacement member and the cover member and that displaces the first displacement member from the initial position to the stop position in synchronization with an opening operation of the cover member;

a second device that is positioned within the main body casing and has a second function different from the first function of the first device;

a second displacement member that is positioned in the main body casing and is configured to displace between an initial position and a stop position which causes the second device to perform a second action; and a second string-like connection that is connected between the second displacement member and the cover member and that displaces the second displacement member from the initial position to the stop position in synchronization with an opening operation of the cover member, wherein the first and second string-like connections, and the first and second displacement members in the stop position, constitute an opening restricting device and configured to restrict the opening angle of the cover member to a prescribed angle.

2. The image forming apparatus according to claim 1, further comprising a top-opening operation capable of moving the cover member, wherein the hinge shaft is positioned in a lower part of the opening provided in the main body casing, wherein the first displacement member and the second displacement member are positioned opposite each other on right and left side surfaces in the main body casing, and wherein first and second displacement members and right and left side portions on a rear surface of the cover member are each connected by the first and second string-like connections.

3. The image forming apparatus according to claim 2, wherein the rear surface of the cover member includes a take-up device that takes up the first and second string-like connections and a stopper device that restricts a further draw-out of the first and second string-like connections when a draw-out amount of the string-like connections drawn out of the take-up device has reached a specific amount, wherein in the process of the opening operation of the cover member, the first and second string-like connections are drawn out of the take-up device against a take-up force, and wherein the draw-out of the string-like connections is restricted by the stopper device when the opening angle of the cover member has become a prescribed angle and the draw-out amount of the string-like connections has reached a specific amount.

4. The image forming apparatus according to claim 3, further including a draw-in restricting means that restricts the take-up of the string-like connections by the take-up device in the process of a closing operation of the cover member, and when the cover member is in a closing posture, the take-up force of the take-up device has no effect on the first and second displacement members via the first and second string-like connections.

5. The image forming apparatus according to claim 4, wherein the draw-in restricting means extends from a protrusion that is fixedly provided on the string-like connection and the take-up of the string-like connection by the take-up device is restricted when the protrusion that has been drawn in to the cover member side along with the string-like connection which abuts against other parts in the process of a closing operation of the cover member.

6. The image forming apparatus according to claim 5, wherein the take-up device comprises a pulley device having at least one movable pulley and biasing means that biases the movable pulley, and wherein the draw-out of the string-like connection is due to a displacement action that resists a biasing force of the movable pulley and the take-up of the string-like connection is due to a displacement action that obeys the biasing force of the movable pulley.

7. The image forming apparatus according to claim 6, wherein the take-up device is of both-end draw-out type in which at least one string-like member is positioned across a plurality of pulleys including the movable pulley so that both of two ends are a free end capable of being drawn out, and wherein both free ends of the string-like member are each fixed to the first displacement member and the second displacement member.

8. The image forming apparatus according to claim 7, wherein both of the first displacement member and the second displacement member are sliders that are configured to perform a forward moving action toward the opening side of the main body casing or a backward moving action in a reverse direction as the displacement action.

9. The image forming apparatus according to claim 8, wherein the movable pulley includes a pulley holder, and when the draw-out amount of the string-like connection has reached aprescribed amount, part of the pulley holder abuts against other parts and the displacement action of the movable pulley is restricted, and the draw-out of the string-like connection is restricted.

10. The image forming apparatus according claims 9, wherein the string-like connection is a strand wire made of stainless steel.

11. The image forming apparatus according to claim 8, wherein the main body casing is provided with a unit housing space and an image forming unit, which is such that a developing device and an image carrying member are provided side by side in a plurality of sets, and is configured to be put into or out of the unit housing space through the opening, wherein the first device first function is a depressing device comprising a movable member having a plurality of working portions for depression to correspond to the plurality of developing devices, and conveyance means that moves the movable member to a depressing position, causes each of the working portions to engage with each of the developing devices of the image forming unit, and due to engagement, each of the image carrying members corresponding to each developer carrying member constituting the developing device to depress the developer carrying members, and wherein the first displacement member displaces the movable member in the depressing position to a disengaging position by a displacement action from the initial position to the stopposition, thereby undoing the engagement by the working portion for depression.

12. The image forming apparatus according to claim 11, wherein the main body casing is provided with a unit housing space and an image forming unit, and a unit frame configured to hold a charger and the plurality of sets of developing devices and image carrying members, and is configured to be put into or out of the unit housing space through the opening, the unit frame having a frame housing space therein, wherein the second device second function is an air blowing device including an air blower and an air blowing duct capable of a displacement action between an insertion posture, which enables the air supplied by the air blower by bringing part of the duct close to the unit frame of the image forming unit while inserting part of the duct into the frame housing space to be fed to the charger within the unit frame, and a retraction posture, which causes part of the duct to be retracted from the frame housing space, and wherein the second displacement member displaces the air blowing duct from the insertion posture to the retraction posture by a displacement action from the initial position to the stop position.

13. The image forming apparatus according to claim 7, wherein the movable pulley includes a pulley holder, and when the draw-out amount of the string-like connection has reached a prescribed amount, part of the pulley holder abuts against other parts and the displacement action of the movable pulley is restricted, and the draw-out of the string-like connection is restricted.

14. The image forming apparatus according to claim 6, wherein the movable pulley includes a pulley holder, and when the draw-out amount of the string-like connection has reached a prescribed amount, part of the pulley holder abuts against other parts and the displacement action of the movable pulley is restricted, and the draw-out of the string-like connection is restricted.

15. The image forming apparatus according to claim 4, wherein the take- up device comprises a pulley device having at least one movable pulley and biasing means that biases the movable pulley, and wherein the draw-out of the string-like connection is due to a displacement action that resists a biasing force of the movable pulley and the take-up of the string-like connection is due to a displacement action that obeys the biasing force of the movable pulley.

16. The image forming apparatus according to claim 7, wherein the movable pulley includes a pulley holder, and when the draw-out amount of the string-like connection has reached a prescribed amount, part of the pulley holder abuts against other parts and the displacement action of the movable pulley is restricted, and the draw-out of the string-like connection is restricted.

17. The image forming apparatus according to claim 3, wherein the take-up device comprises a pulley device having at least one movable pulley and biasing means that biases the movable pulley, and wherein the draw-out of the string-like connection is due to a displacement action that resists a biasing force of the movable pulley and the take-up of the string-like connection is due to a displacement action that obeys the biasing force of the movable pulley.

18. The image forming apparatus according to claim 17, wherein the movable pulley includes a pulley holder, and when the draw-out amount of the string-like connection has reached a prescribed amount, part of the pulley holder abuts against other parts and the displacement action of the movable pulley is restricted, and the draw-out of the string-like connection is restricted.

* * * * *